US006208311B1

(12) United States Patent
Reece et al.

(10) Patent No.: US 6,208,311 B1
(45) Date of Patent: Mar. 27, 2001

(54) DIPOLE ANTENNA FOR USE IN WIRELESS COMMUNICATIONS SYSTEM

(75) Inventors: John Kenneth Reece; John L. Aden, both of Colorado Springs, CO (US)

(73) Assignee: Xircom, Inc., Thousand Oaks, CA (US)

( * ) Notice: Subject to any disclaimer, the term of this patent is extended or adjusted under 35 U.S.C. 154(b) by 0 days.

(21) Appl. No.: 09/387,611

(22) Filed: Aug. 31, 1999

Related U.S. Application Data

(63) Continuation of application No. 09/100,501, filed on Jun. 19, 1998, now Pat. No. 6,121,935, and a continuation of application No. 08/709,275, filed on Sep. 6, 1996, now Pat. No. 5,771,024, and a continuation of application No. 08/673,871, filed on Jul. 2, 1996, now Pat. No. 5,771,025.

(51) Int. Cl.[7] ..... H01Q 9/28
(52) U.S. Cl. ..... 343/795; 343/807
(58) Field of Search ..... 343/795, 807, 343/806; H01Q 9/28

(56) References Cited

U.S. PATENT DOCUMENTS 3,256,522 * 6/1966 De Oliveira ..... 343/807
4,287,518 * 9/1981 Ellis ..... 343/795

* cited by examiner

*Primary Examiner*—Michael C. Wimer
(74) *Attorney, Agent, or Firm*—Lyon & Lyon LLP

(57) ABSTRACT

Improved antennas and antenna systems for use in cellular and other wireless communications systems. A folded mono-bow antenna element is provided which has a substantially omnidirectional radiation pattern in a horizontal plane and shows variation in gain in an elevation plane depending upon the size of an associated ground plane. The folded mono-bow antenna element comprises a main bowtie radiating element and parasitic element wherein the main bowtie radiating element and parasitic element are separated by a dielectric material having a dielectric constant preferably less than 4.5 and, in some cases, less than or equal to 3.3. Various antenna arrays and methods of making the same are also provided.

20 Claims, 30 Drawing Sheets

DIPOLE ANTENNA FOR USE IN WIRELESS COMMUNICATIONS SYSTEM

This application is a continuation of application Ser. No. 09/100,501, filed Jun. 19, 1998, now U.S. Pat. No. 6,121,935, which is a continuation of application Ser. No. 08/709,275, filed Sep. 6, 1996, now U.S. Pat. No. 5,771,024, which in turn is a continuation-in-part of application Ser. No. 08/673,871, filed Jul. 2, 1996, now U.S. Pat. No. 5,771,025.

BACKGROUND OF THE INVENTION

The present invention pertains generally to the field of antennas and antenna systems including, more particularly, antennas and antenna systems for use in cellular and other wireless communications systems.

While substantial recent attention has been directed to the design and implementation of cellular and other wireless communications systems and to the communications protocols utilized by those systems, surprisingly little attention has been directed to the development of improved antennas and antenna systems for use within those communications systems.

Perhaps, the reason for this is that until recently space for the deployment of antenna networks was readily available on the tops of buildings in a dense urban environment. Thus, until recently little attention was paid to the development of relatively small, aesthetically appealing antenna networks which could be deployed, for example, on light poles or telephone poles substantially at street level.

Nor was there any substantial reason, until recently, to address the issue of channeling in the "urban canyon." The term, "urban canyon," as used herein, refers to the linear open space which exists between buildings along streets, for example, in a dense urban environment. As for the issue of channeling within an urban canyon, it has been found that the exterior surfaces (walls and the like) of the buildings lining an urban canyon exhibit characteristics quite similar to the walls of a typical wave guide. Thus, when a radio frequency (RF) signal is transmitted within an urban canyon, the signal tends to propagate for the entire length of the urban canyon with very little attenuation. While this characteristic of an urban canyon may be viewed by some as advantageous, this characteristic raises a serious issue when it is desired to implement a cellular communications network within a dense urban environment. In short, this characteristic makes it difficult for mobile units and base stations alike to identify differences in the strengths of received signals, thus, making it difficult to effect necessary and proper hand-offs between and among the mobile units and base stations. To better understand this principle, one should consider a scenario where a mobile unit enters a four-way intersection within a dense urban environment (i.e., when a mobile unit reaches the intersection point of two urban canyons). Upon entering the intersection, the mobile unit is likely to receive four separate signals of substantially the same amplitude from four separate base stations, and the base stations are likely to receive signals of similar amplitude from the mobile unit. This presents a substantial risk that the mobile unit will be handed-off to an improper base station and, as a result, communications between the mobile unit and the base stations will be terminated prematurely (i.e., the call may be lost).

Another issue which must be addressed in the design of antenna networks for use in "low tier," or street level, deployment schemes is the issue of "multipath" interference. The term "multipath" refers to the tendency of an antenna in a dense urban environment (or any other environment) to receive a single (or the same) signal multiple times as the signal is reflected from objects (poles, buildings and the like) in the area proximate the antenna. To combat multipath interference, it may be desirable to employ one or more pattern or separation diversity methodologies within a given antenna network.

Given the substantial issues of channeling, multipath, size and aesthetics which must be addressed when designing antennas and antenna networks for low tier deployment within a dense urban (or other) environment, it is believed that those skilled in the art would find improved antennas and antenna networks which may be deployed in relatively small, aesthetically appealing packages, and which may provide substantial multipath and channeling mitigation, to be very useful.

SUMMARY OF THE INVENTION

The present invention is directed to the implementation, manufacture and use of improved antenna elements and antenna arrays for use in cellular and other wireless communications systems. The antennas and antenna arrays of the present invention may be deployed in relatively small, aesthetically appealing packages and, perhaps more importantly, may be utilized to provide substantial mitigation of multipath and channeling in a dense urban (or other) environment.

In one innovative aspect, the present invention is directed to the implementation, manufacture and use of a folded mono-bow antenna element. A folded mono-bow antenna element in accordance with the present invention may comprise, for example, a main radiating bowtie element and a parasitic element, wherein the main radiating bowtie element and the parasitic element are separated by a dielectric material and, if desired, may be formed on separate sides of a dielectric substrate, such as a printed circuit board. A shorting element may also provide an electrical connection between a selected portion of the main radiating bowtie element and a selected portion of the parasitic element. The main radiating bowtie element may be coupled to a feed pin mounted through an insulated hole formed in an associated ground plane, and the parasitic element may be mounted to the ground plane. A folded mono-bow antenna in accordance with the present invention may have a substantially omnidirectional radiation pattern in the horizontal plane, a radiation pattern which varies in the elevation plane depending upon the size of an associated ground plane, and may be dimensioned to provide transmission and reception over a fairly broad bandwidth centered, for example, at a frequency of 1920 MHZ. This makes the folded mono-bow antenna of the present invention quite suitable for use in cellular and other wireless communications systems.

In one innovative arrangement, a pair of folded mono-bow antennas (or other monopole antennas) may be configured to provide a dual pattern diversity folded mono-bow array. In such an embodiment, two folded mono-bow antenna elements (or other monopole antenna elements) may be mounted on a common ground plane and fed by a 180° ring hybrid combiner/splitter circuit. By combining a pair of folded mono-bow antenna elements in this fashion, it is possible to achieve a radiation pattern which exhibits reduced azimuth beam width orthogonal beam pairs. Thus, a dual pattern diversity folded mono-bow antenna array in accordance with the present invention is particularly well suited for use with communications systems which utilize pattern diversity to mitigate multipath.

In another innovative arrangement, four of the aforementioned dual pattern diversity folded mono-bow arrays may be configured to provide a dual polarized 4-way diversity antenna array. In such an embodiment, the ground planes of the respective dual pattern diversity folded mono-bow arrays may be arranged such that selected pairs of the ground planes form parallel and opposing surfaces, and such that adjacent pairs of the ground planes have an orthogonal relationship to one another.

In still another innovative arrangement, four folded mono-bow antenna elements (or other monopole antenna elements) may be configured to provide a 4-beam monopole diversity antenna array. In such an embodiment, four folded mono-bow antenna elements may be mounted on a common ground plane along a common axis and fed by a butler matrix combiner.

In still another innovative arrangement, two folded mono-bow antenna elements may be configured to provide an omnidirectional dual pattern diversity antenna array. In such an embodiment, a pair of folded mono-bow antenna element may be coupled to a 180° hybrid combiner network and oriented along a common axis in contra-direction to one another.

In still another innovative arrangement, two folded mono-bow antenna elements and two contradirectionally oriented "T" shaped antenna elements may be configured to provide a dual polarized bi-directional diversity antenna array. In such an embodiment, the pair of folded mono-bow antenna elements are coupled to a first summing circuit, and the pair of contradirectionally oriented "T" shaped antenna elements are coupled to a second summing circuit. The pairs of folded mono-bow antenna elements and "T" shaped antenna elements are oriented along orthogonal axes of a common ground plane.

Accordingly, it is an object of one aspect of the present invention to provide improved antenna elements for use in cellular and other wireless communications systems.

It is another object of an aspect of the present invention to provide improved antennas and antenna arrays for use in cellular and other wireless communications systems.

It is still another object of an aspect of the present invention to provide improved antennas and antenna networks which may provide substantial mitigation of multipath and channeling in a dense urban (or other) environment.

It is still another object of an aspect of the present invention to provide improved methods for manufacturing antennas and antenna arrays for use in cellular and other wireless communications systems.

It is still another object of an aspect of the present invention to provide improved methods for using antennas and antenna systems within cellular and other wireless communications systems.

These and other objects, features and advantages will be more clearly understood from the following detailed description taken in conjunction with the accompanying drawings.

BRIEF DESCRIPTION OF THE DRAWINGS

FIG. 1(*b*) is a frontal view of the folded mono-bow antenna illustrated in FIG. 1(*a*).

FIG. 1(*c*) is a back view of the folded mono-bow antenna illustrated in FIG. 1(*a*).

FIG. 2(*b*) is an illustration of a parasitic element formed on a second side of a printed circuit board substrate in accordance with a preferred form of the present invention.

FIG. 4(*b*) is an illustration of a combiner/ splitter circuit utilized in a preferred form of a dual pattern diversity folded mono-bow antenna array. 3(*a*).

FIG. 4(*c*) illustrates the layout of the metal traces forming the combiner/splitter circuit shown in FIG. 4(*b*).

FIG. 4(*d*) is an illustration of an alternative layout for the combiner/splitter circuit of FIG. 4(*b*).

FIG. 4(*e*) is an illustration of one side of a ground plane.

FIG. 4(*f*) is an illustration of one embodiment of a dual pattern diversity folded mono-bow antenna array with opposite facing elements.

FIG. 4(*g*) is an illustration of an exploded view of the mono-bow antenna array of FIG. 4(*f*).

FIG. 4(*h*) is an illustration of an exploded view of an antenna embodying aspects of the present invention.

FIG. 7(*b*) is an illustration of a butler matrix utilized in the 4-beam monopole diversity antenna array illustrated in FIG. 7(*a*).

FIG. 7(*c*) shows the preferred dimensions of the metal traces forming the butler matrix circuit illustrated in FIG. 7(*b*).

FIG. 12(*b*) is an illustration of the preferred microstrip feed circuits utilized in the dual polarized bi-directional diversity antenna array shown in FIG. 12(*a*).

FIG. 12(*c*) is an illustration of the coax cable feeds utilized in the dual polarized bi-directional diversity antenna array shown in FIG. 12(*a*).

FIG. 12(*d*) is a view of the parasitic element of a presently preferred folded mono-bow element.

FIG. 12(*e*) is a view of the radiating element of a presently preferred folded mono-bow element.

FIG. 13(*b*) is an illustration of an inductive feed element of a preferred "T" shaped antenna element utilized in the dual polarized bi-directional diversity antenna array shown in FIG. 12(*a*).

FIG. 14(*b*) is an illustration of a horizontally polarized principal plane radiation pattern in a horizontal plane produced at the folded mono-bow antenna feed port of a dual polarized bi-directional diversity antenna when the antenna is mounted in accordance with the present invention.

FIG. 14(*c*) is an illustration of a vertically polarized conic cut radiation pattern in a vertical plane produced at the "T" shaped antenna feed port of a dual polarized bi-directional diversity antenna when the antenna is mounted in accordance with the present invention.

FIG. 14(*d*) is an illustration of a vertically polarized principal plane radiation pattern in a vertical plane produced at the "T" shaped antenna feed port of a dual polarized bi-directional diversity antenna when the antenna is mounted in accordance with the present invention.

DESCRIPTION OF PREFERRED EMBODIMENTS

Figure 1A:
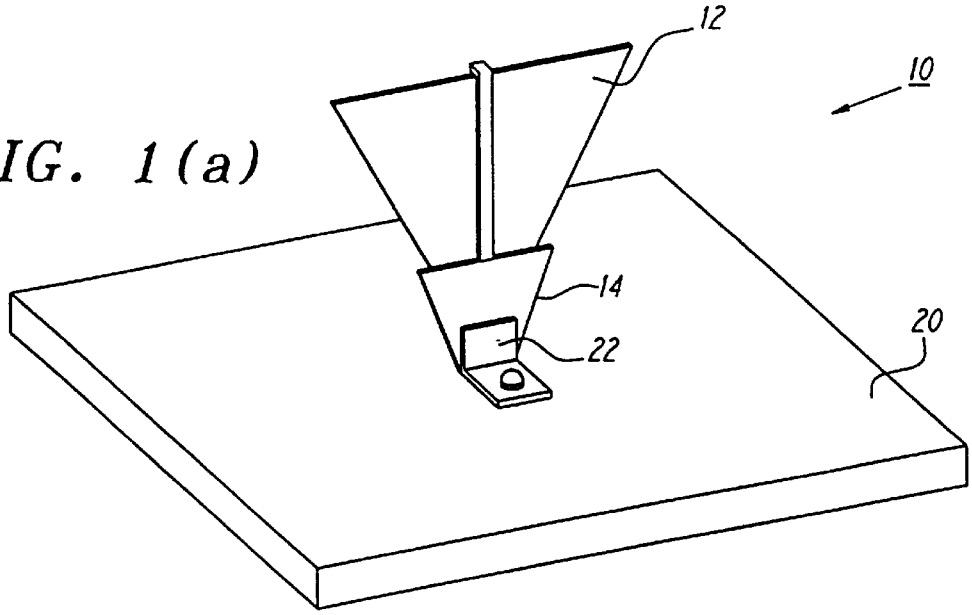
FIG. 1(*a*) is an illustration of a folded mono-bow antenna in accordance with the present invention.

In an effort to highlight various embodiments and innovative aspects of the present invention, a number of subheadings are provided in the following discussion. Further, where a given structure appears in several drawings, that structure is labeled using the same reference numeral in each drawing.

Folded Mono-Bow Antenna Elements

Figure 1B:
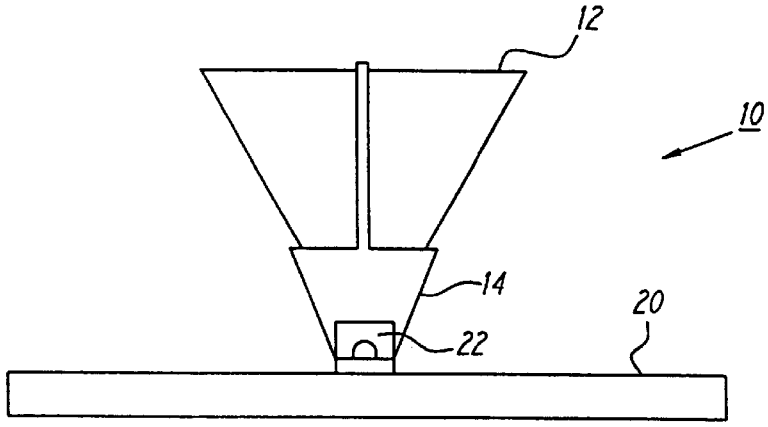
Figure 1C:
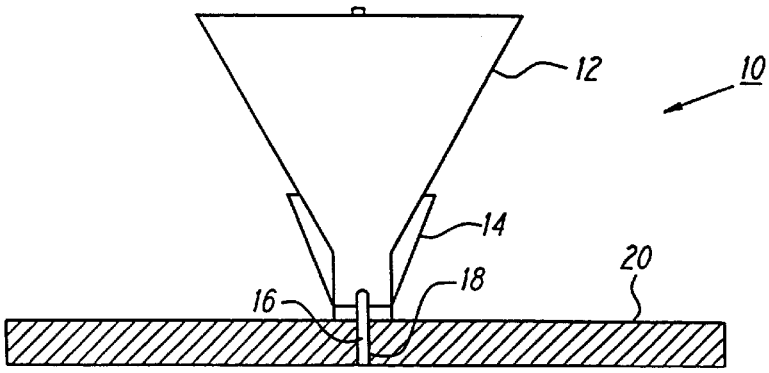

Turning now to the drawings, in one innovative aspect the present invention is directed to the implementation of a folded mono-bow antenna element 10 and to methods of manufacturing and using the same. As shown in FIGs. 1(*a*)–1(*c*), a folded mono-bow antenna element 10 comprises a large bowtie radiating element 12, which provides the primary means of power transfer and impedance matching for the antenna 10, and a smaller grounded parasitic element 14, which provides a capacitive matching section for the input impedance of the antenna 10. The main bowtie radiating element 12 is mounted to a feed pin 16, which extends through an insulated hole 18 formed in an associated ground plane 20, and the parasitic element 14 is preferably mounted to a brass angle 22 which, in turn, is coupled to the ground plane 20. In a preferred form, the insulated hole 18 has a diameter of substantially 0.160 inches, and the feed pin 16 has a diameter of 0.050 inches.

Figure 2A:
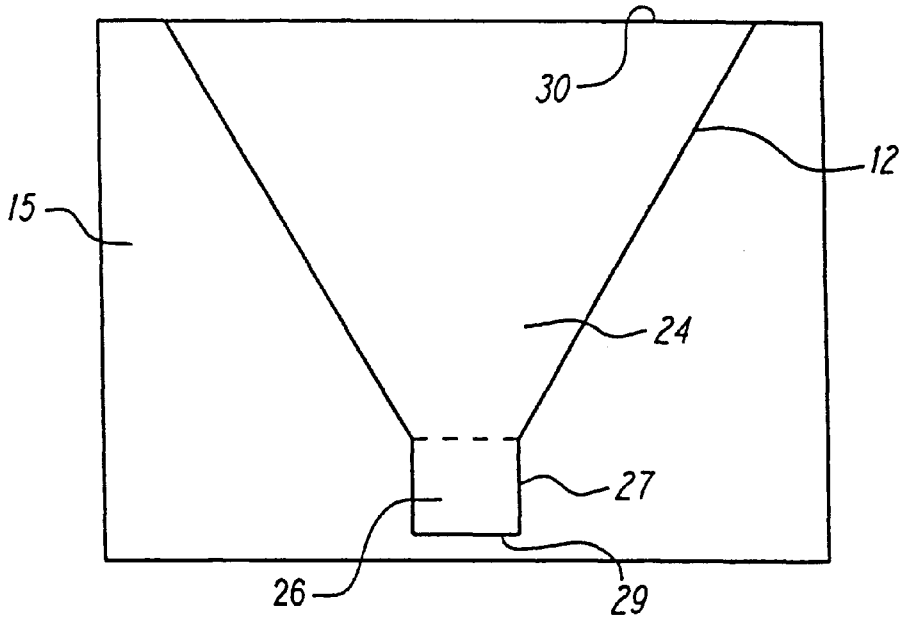
FIG. 2(*a*) is an illustration of a main bowtie radiating element formed on a first side of a printed circuit board substrate in accordance with a preferred form of the present invention.
Figure 2B:
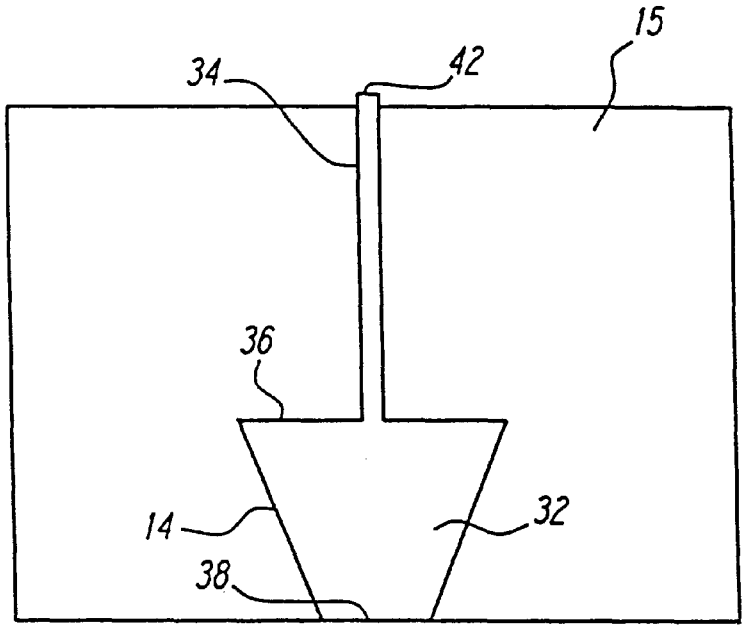

Turning now also to FIGS. 2(*a*) and 2(*b*), in a preferred form the main bowtie radiating element 12 and the parasitic element 14 are separated by a dielectric material 15 (e.g., air or some other dielectric material) having a dielectric constant which is preferably less than or equal to 4.5. Further, while the shape and dimensions of the main bowtie radiating element 12 and parasitic element 14 may vary depending upon the operational characteristics desired for a particular application, it is presently preferred that the main bowtie radiating element 12 comprise two sections, a main radiating section 24 having a substantially symmetric trapezoidal shape and a pin coupling section 26 having a substantially rectangular shape. Further, as shown in FIG. 2(*a*), it is presently preferred that the main bowtie radiating element 12 have a height $H_{MRE}$ substantially equal to 1.070 inches, that an upper edge 30 of the main bowtie radiating element 12 have a length substantially equal to 1.070 inches, and that the pin coupling section 26 of the main bowtie radiating element 12 have parallel side edges 27 measuring substantially 0.145 inches in length and a bottom edge 29 measuring substantially 0.200 inches in length.

As for the parasitic element 14, it is presently preferred that the parasitic element 14 also comprise two sections, a parasitic section 32 having a substantially symmetric trapezoidal shape and a shorting section 34 having a substantially rectangular shape. Moreover, it is presently preferred that the parasitic section 32 have an upper edge 36 measuring substantially 0.600 inches in length, a lower edge 38 measuring substantially 0.175 inches in length and a height $H_{PS}$ substantially equal to 0.475 inches, that the shorting section 34 have a width $W_{SS}$ substantially equal to 0.050 inches and a height $H_{SS}$ substantially equal to 0.625 inches, and that an upper tip portion of the shorting section 34 be electrically coupled via a cap 42 or other means such as, for example, a metal trace or plated through hole, to a central portion of the upper edge 30 of the main radiating section 24 of the main bowtie radiating element 12.

Finally, with regard to the dielectric material 15 and the manufacture of a folded mono-bow antenna element 10, it is presently preferred that the dielectric material 15 comprise a section of printed circuit board constructed from woven TEFLON®, that the dielectric material 15 have a thickness of substantially 0.062 inches, and that the dielectric material 15 have an epsilon value (or dielectric constant) between approximately 3.0 and 3.3. Moreover, it will be appreciated that a folded mono-bow antenna element 10 may be and is preferably manufactured by depositing copper cladding in a conventional manner over opposite surfaces (not shown) of a printed circuit board, and etching portions of the copper cladding away to form the main bowtie radiating element 12 and parasitic element 14.

Figure 3:
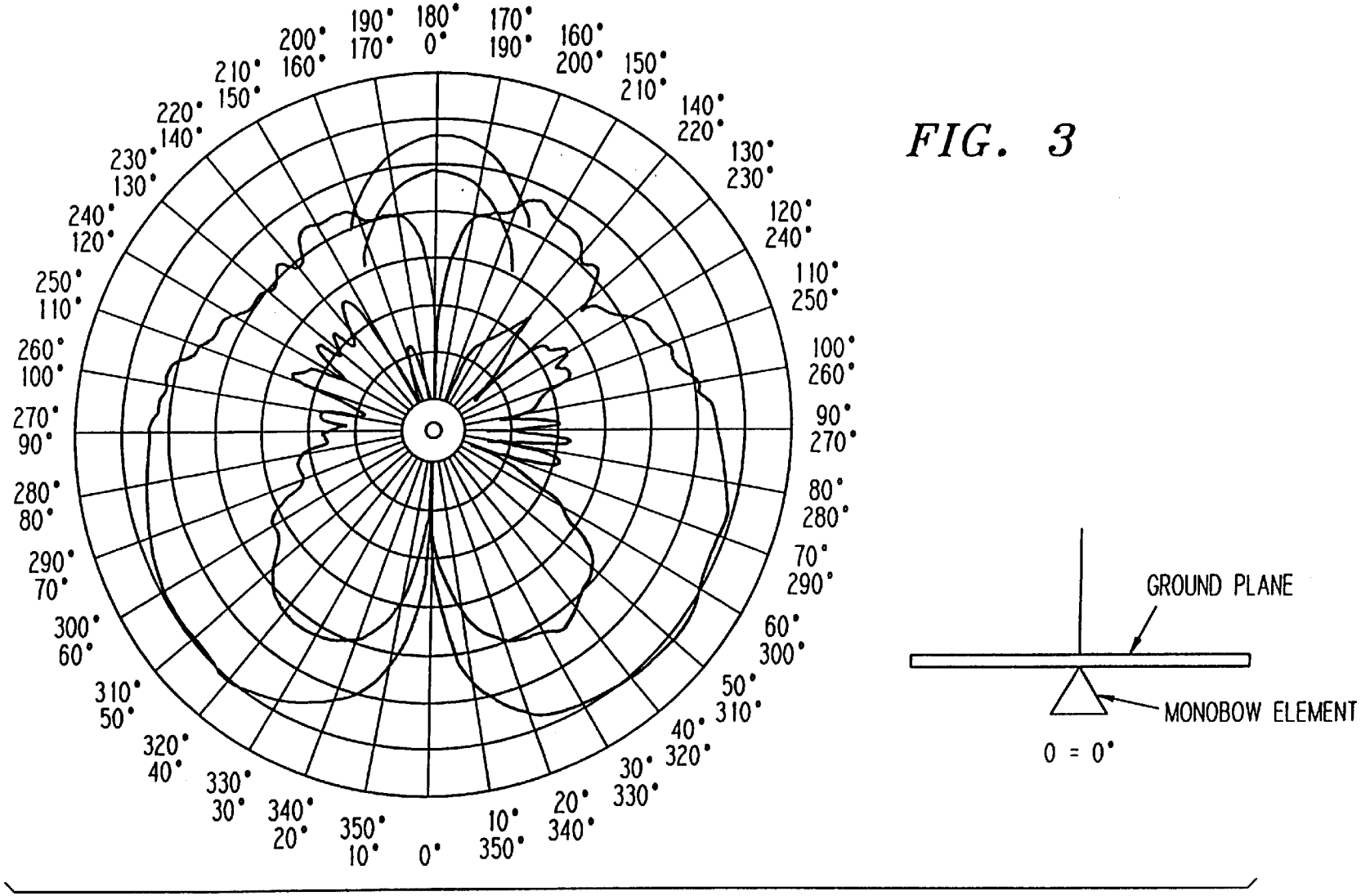
FIG. 3 provides an exemplary illustration of a radiation pattern in an elevation plane of a folded mono-bow antenna in accordance with the present invention.

Turning also to FIG. 3, the radiation pattern 42 of a folded mono-bow antenna element 10 in accordance with the present invention is substantially omnidirectional in $\phi$ (i.e., in the horizontal plane), has nulls at $\Theta=0°$ and 180°, and with a ground plane measuring 4.0 inches by 4.0 inches, shows gain at $\Theta=50°$ and 310° in the elevation plane. However, it will be appreciated that the shape of the radiation pattern in the elevation plane will vary depending upon the size and shape of the ground plane 20.

Further, when dimensioned as described above, a folded mono-bow antenna element 10 may be configured for optimal transmission and reception at a frequency of substantially 1920 MHZ, and may also provide adequate operational characteristics for transmission and reception in a frequency band between 1710 MHZ and 1990 MHZ.

Dual Pattern Diversity Antenna Arrays

Turning now to FIGS. 4(*a*)–4(*c*), in another innovative aspect the present invention is directed to the implementation, manufacture and use of dual pattern diversity antenna arrays. As shown in FIG. 4(*a*), a dual pattern diversity folded mono-bow antenna array 44 may comprise a pair of folded mono-bow antenna elements 10*a* and 10*b*, a common ground plane 46, and a 180° ring hybrid combiner/splitter circuit 48 (shown in FIGS. 4(*b*) and 4(*c*)).

In a preferred form, the common ground plane 46 may comprise a printed circuit board substrate having opposing coplanar surfaces (i.e. a top surface and a bottom surface) whereon respective layers of copper cladding are deposited, and the 180° ring hybrid combiner/splitter circuit 48, shown in FIGS. 4(*b*) and 4(*c*), may be formed by etching away portions of the copper cladding deposited on one of the surfaces of the printed circuit board substrate. In addition, the copper cladding layer deposited upon the top surface of the printed circuit board substrate and portions of the copper cladding layer deposited on the bottom surface of the printed circuit board substrate (not including those portions of the copper cladding layer which comprise the 180° hybrid combiner/splitter circuit 48) may be electrically connected by a series of plated through-holes 49 formed in the printed circuit board substrate. This may be done to insure that the respective copper cladding layers form a single, unified ground plane. The presently preferred dimensions of the metal traces forming the 180° ring hybrid combiner/splitter circuit 48 shown in FIG. 4(*c*) are as follows. For line segment A-B, 0.5786 inches. For line segment B-C, 0.089 inches. For line segment C-D, 0.386 inches. For line segment D-E, 0.089 inches. For line segment E-F, 0.5786 inches. For line segment F-G, 0.771. For line segments G-H and J-K, 0.1 inches. For line segments H-I and I-K, 0.771 inches. For line segments L-K and H-N, 0.879 inches. For line segments L-M and N-O, 0.4855 inches. The presently preferred line widths for line segments B-B, B-C, C-D, D-E, E-F, F-G, G-I, and I-J is 0.031 inches and 0.058 for the remaining line widths. It is presently preferred to couple the sum and difference ports 50*b* and 50*a* of the 180° ring hybrid combiner/splitter circuit 48 to standard type N coax connectors 71 preferably sized to receive 0.875 inch (⅞") cable.

In a most presently preferred alternative embodiment shown in FIG. 4(*d*), the sum and difference ports 50*b* and 50*a* are not brought to the edge of the ground plane using metal traces. Instead, metal pads are preferably plated close to the combiner splitter circuit and wires 70 are bonded to those pads connecting the coax connectors 71 to the sum and difference ports. (FIG. 4(*e*)).

Turning back to FIG. 4(*a*), the folded mono-bow antenna elements 10*a* and 10*b* may be mounted along a central axis 47 of the common ground plane 46 and should be separated by a distance substantially equal to 0.5 λ to 0.7 λ of the radio frequency waves to be transmitted and received by the antenna array 44. The elements are shown mounted with an angle bracket 21 and a fastener 22 contiguous with the parasitic element 14. As it is presently preferred that the folded mono-bow antenna elements 10*a* and 10*b* provide for optimal transmission and reception at a frequency of 1920 MHZ, the folded mono-bow antenna elements 10*a* and 10*b* are, preferably, separated by a distance of substantially 3.1 to 4.3 inches. It is also presently preferred that the common ground plane 46 be substantially rectangular in shape, have a width of substantially 6.0 inches and have a length of substantially 8.0 inches. However, it should be appreciated that by varying the dimensions of the common ground plane 46 it is possible to vary the radiation pattern of the antenna array 44 to meet (or attempt to meet) the system design goals of a given installation site. Moreover, depending upon the design goals of a given installation, it may be desirable to modify the dimensions of the ground plane 46, the spacing of the elements, the dimensions of the folded mono-bow antenna elements 10*a* and 10*b* or, perhaps, in some circumstances to substitute some other type of antenna (for example, another type of monopole antenna) for the antenna elements 10*a* and 10*b* described above.

Figure 4A:
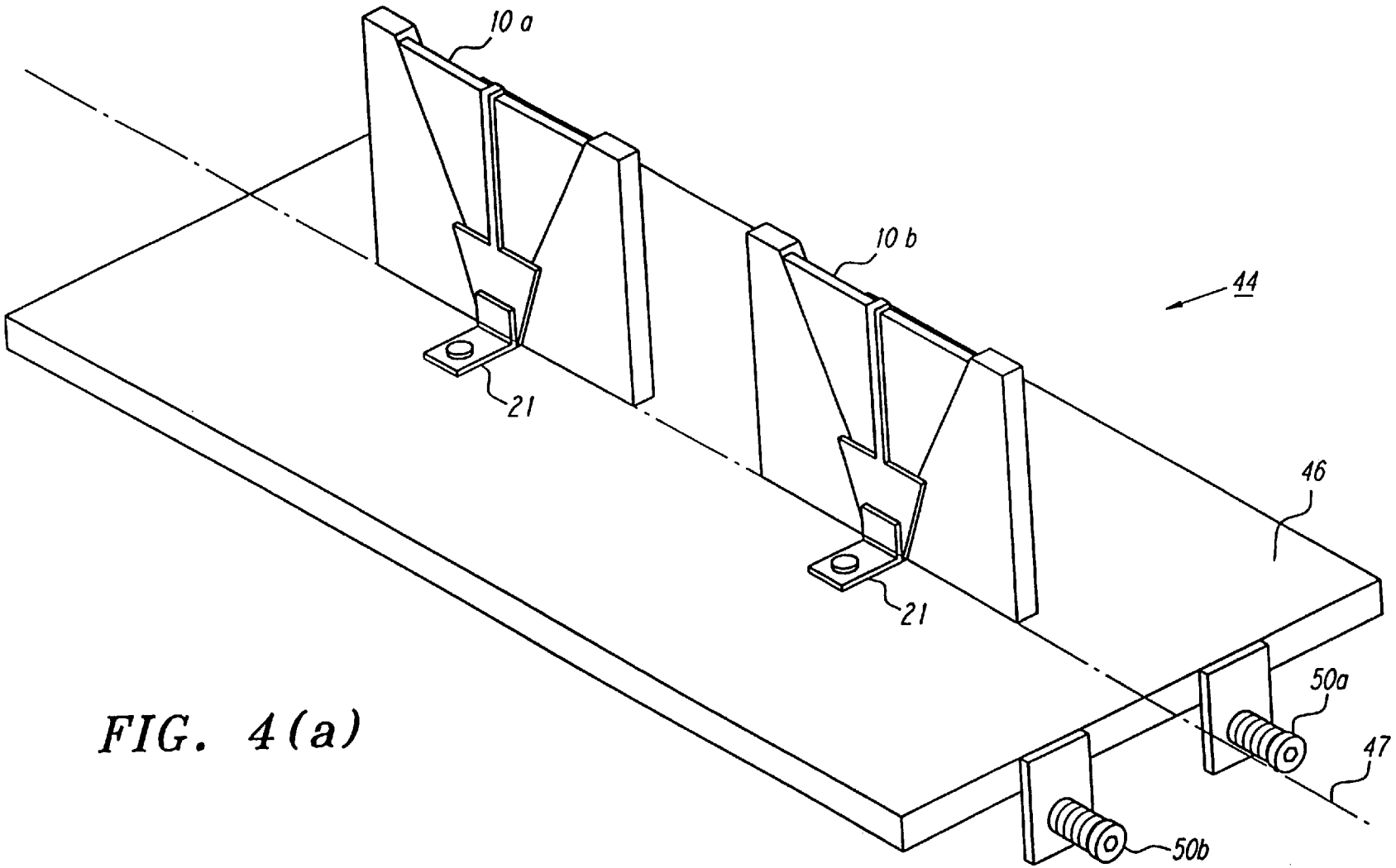
FIG. 4(*a*) is an illustration of a dual pattern diversity folded mono-bow antenna array.
Figure 4B:
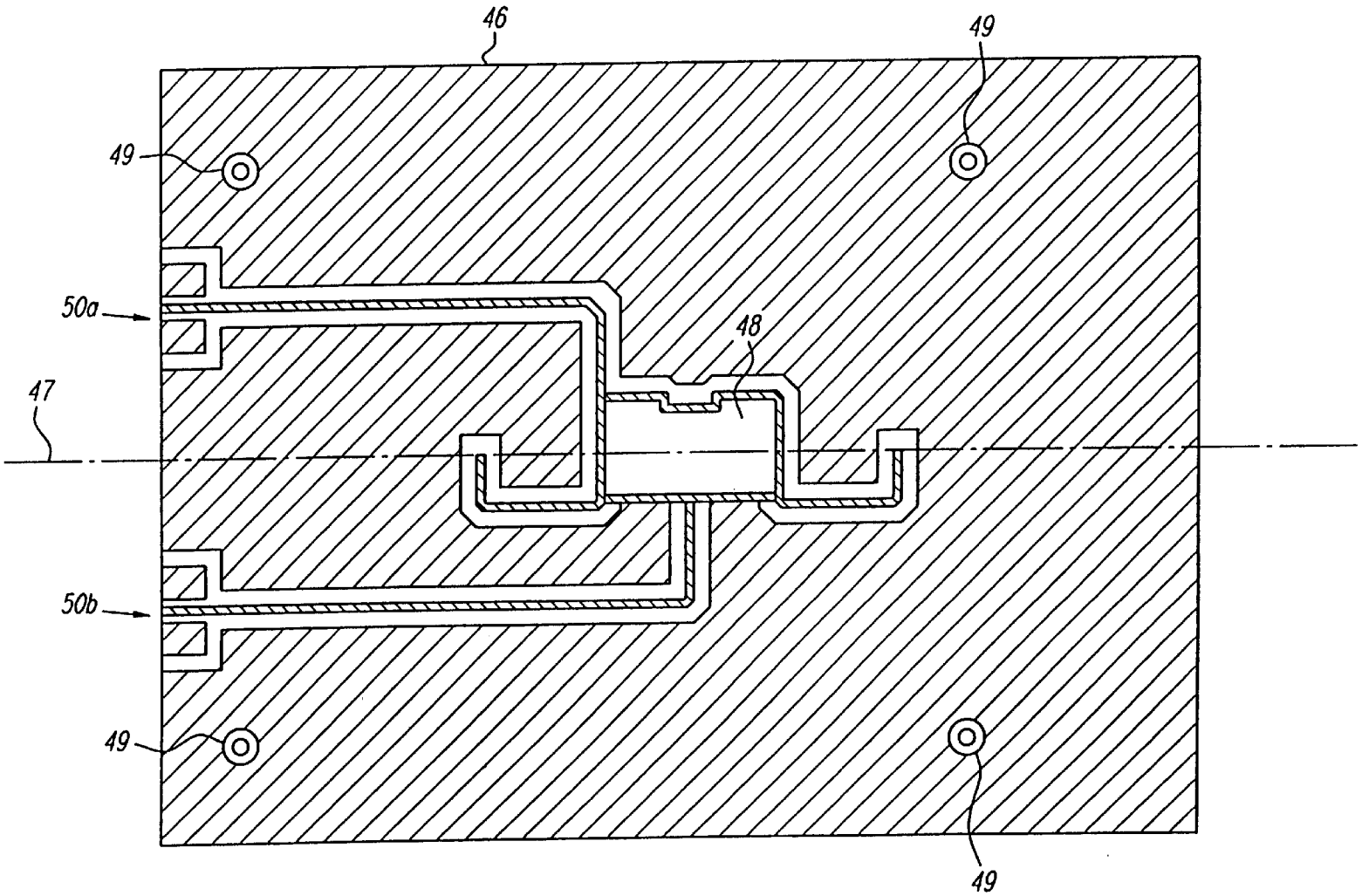
Figure 4C:
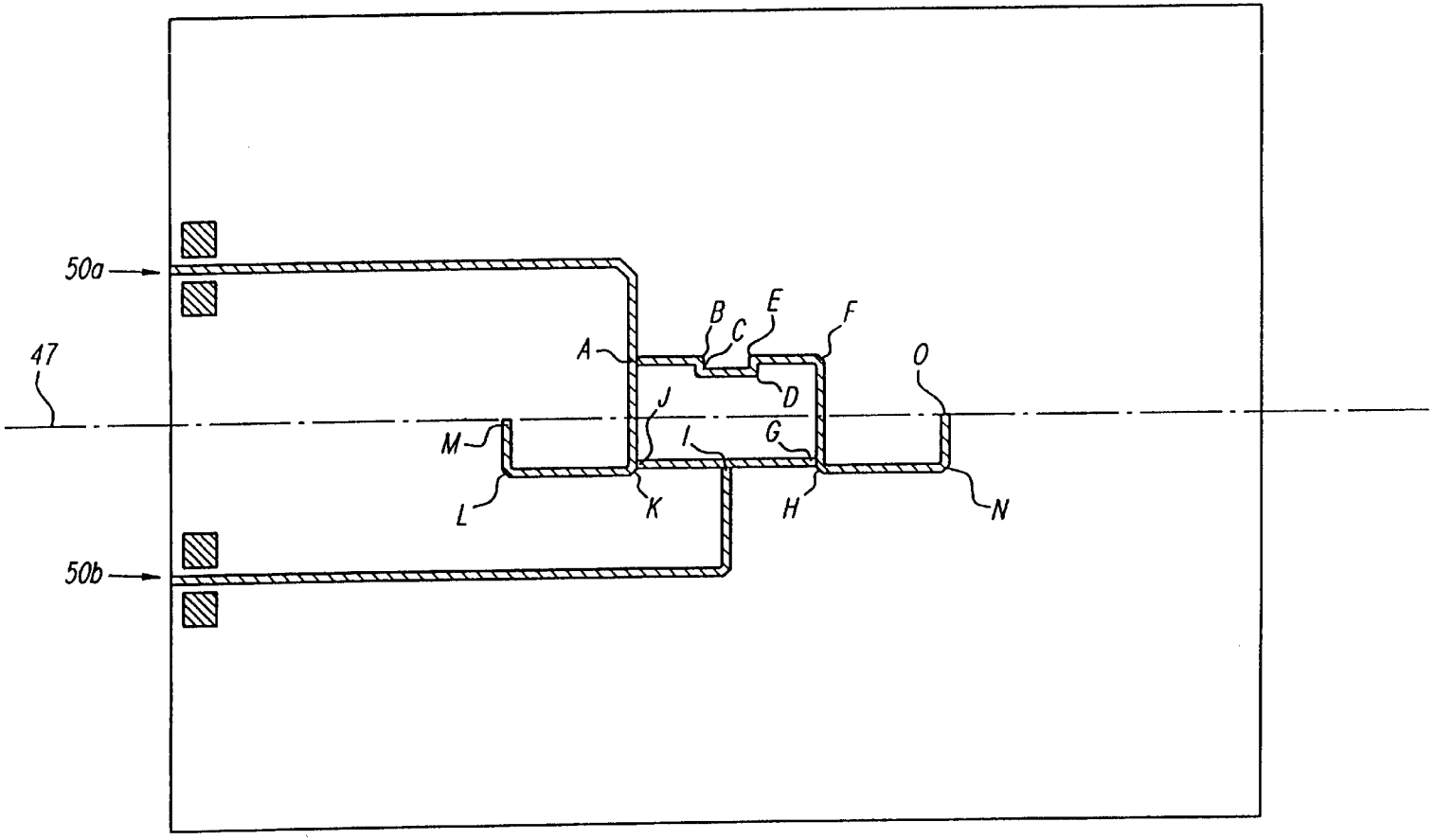
Figure 4D:
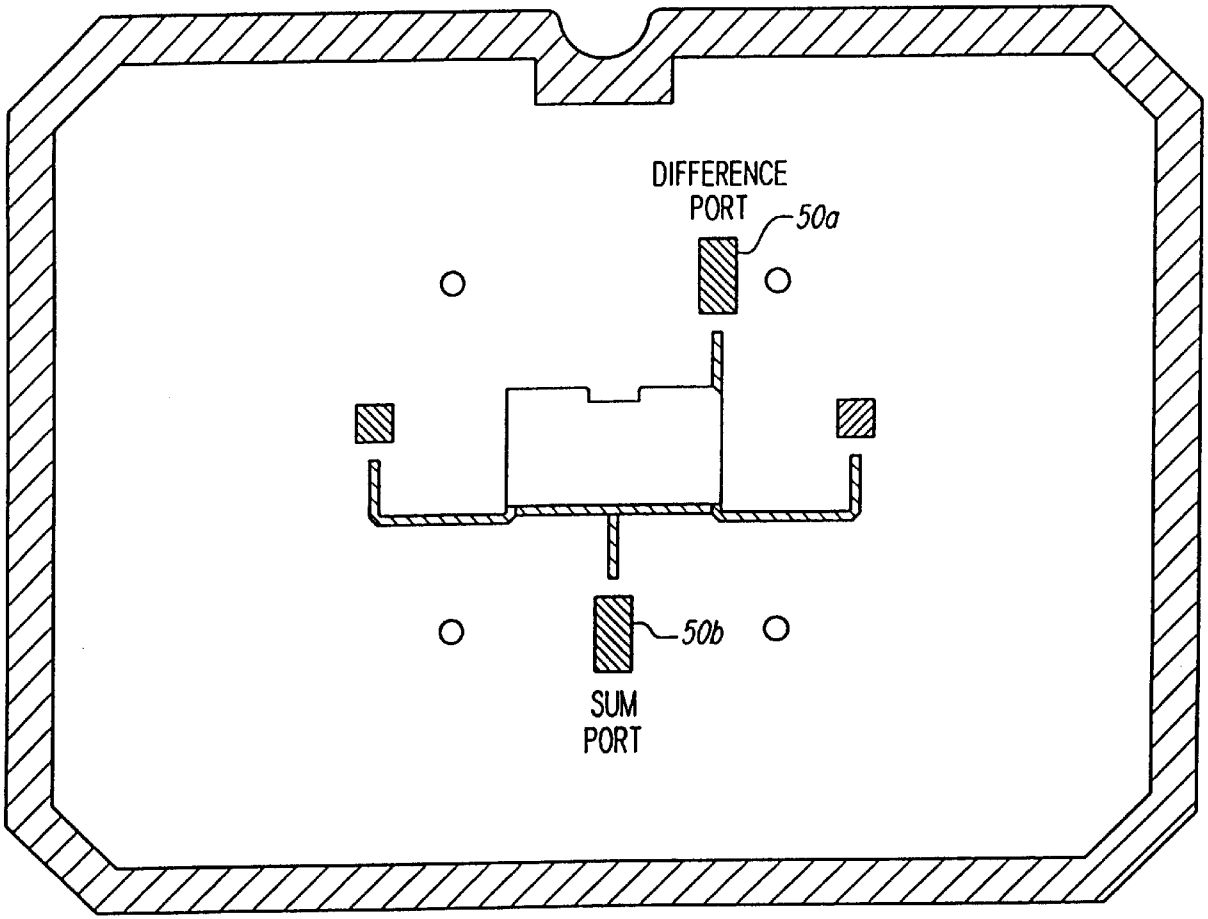
Figure 4E:
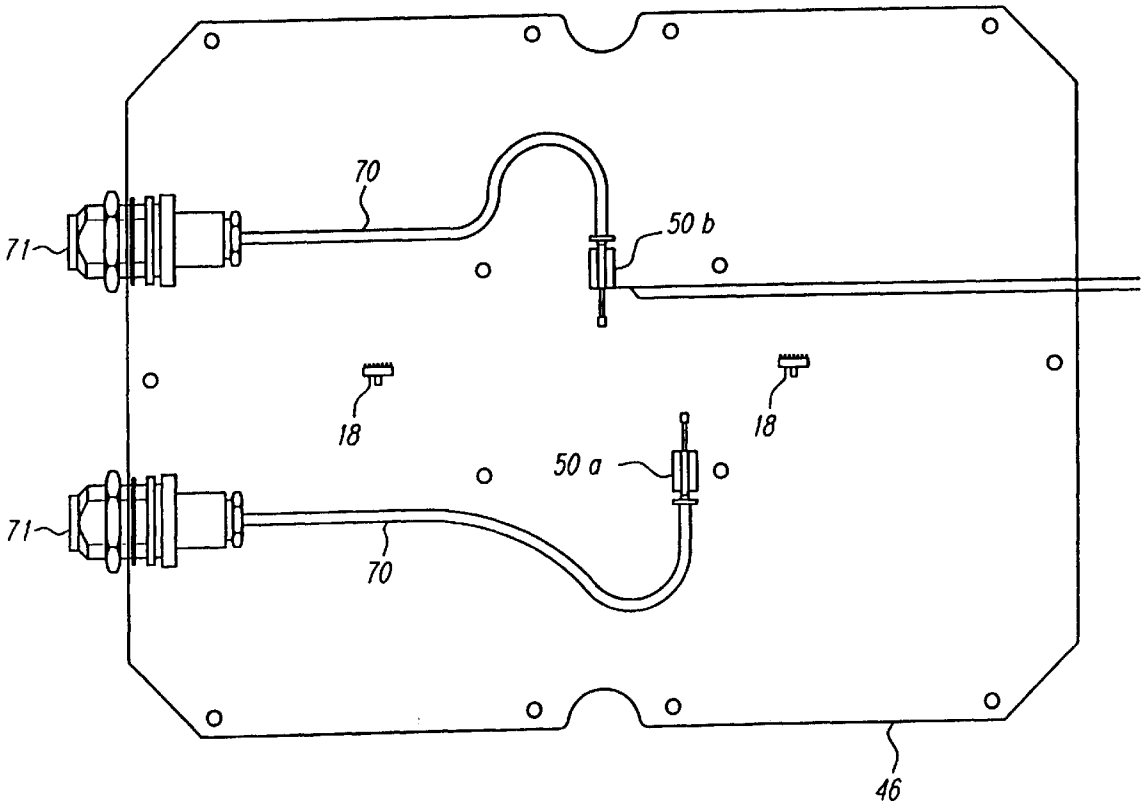
Figure 4F:
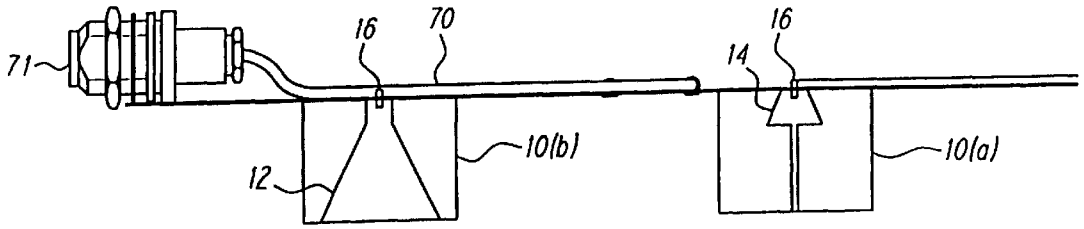
Figure 4G:
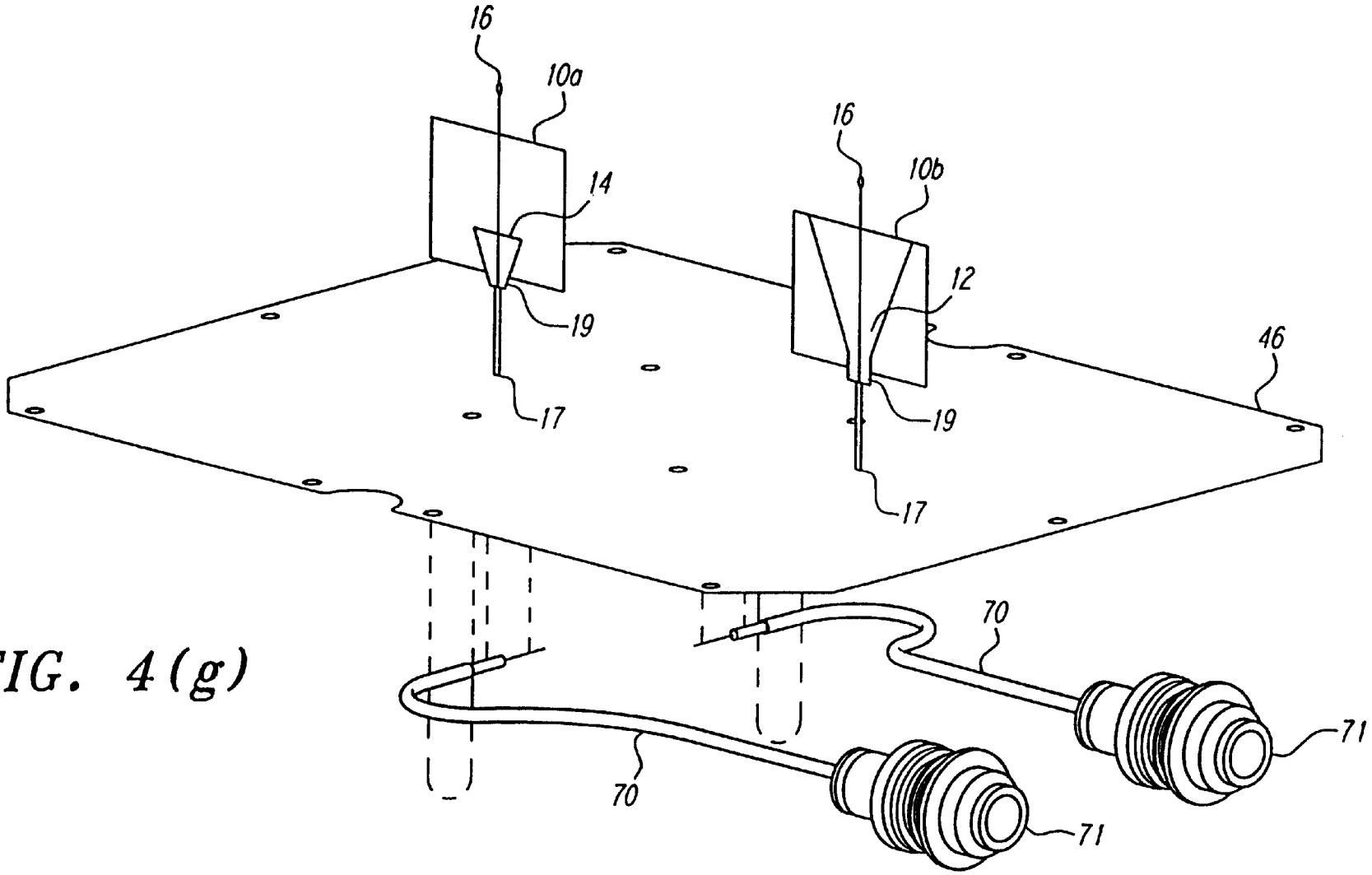
Figure 4H:
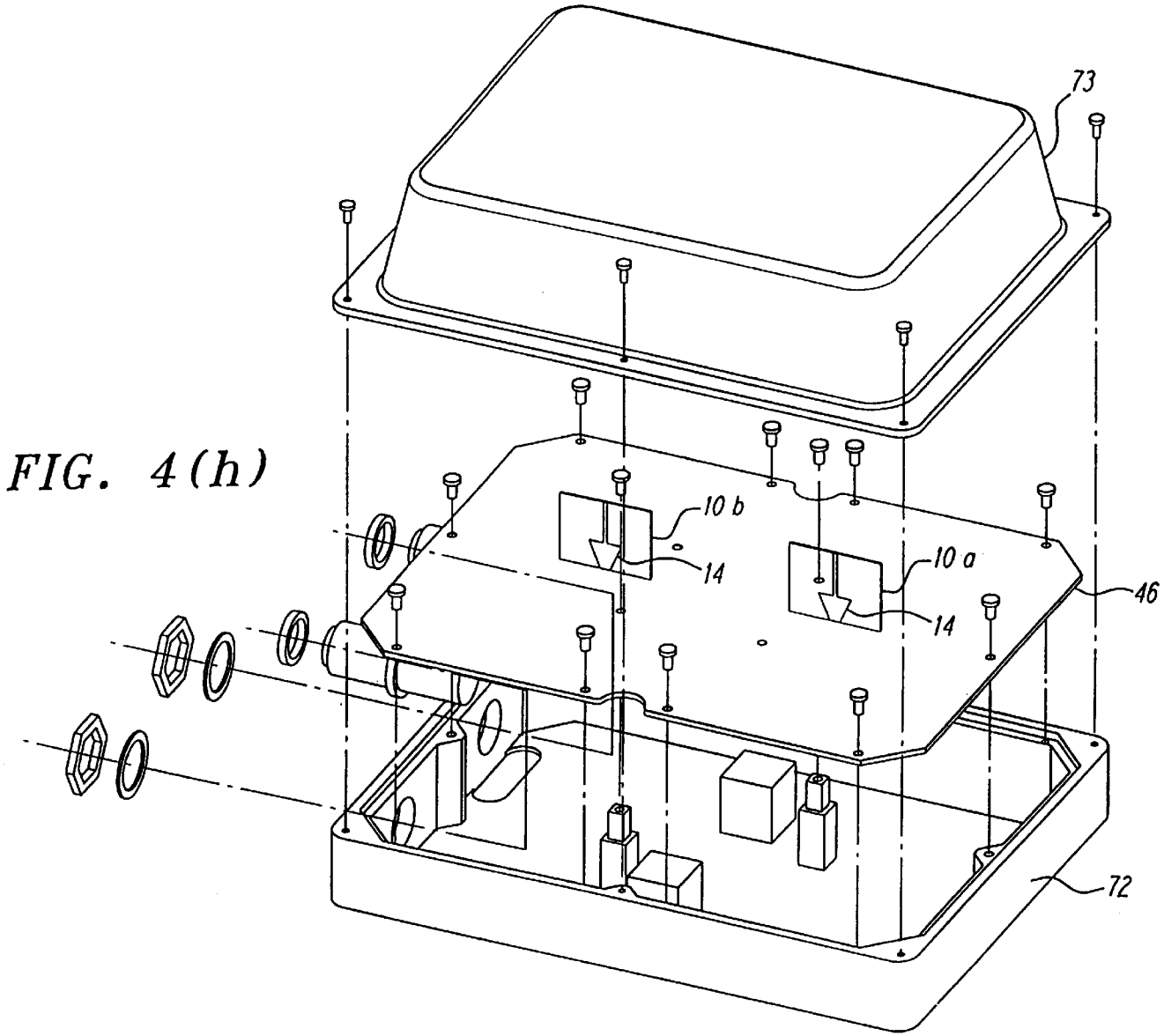

As shown in FIGS. 4*f* and 4*g*, it is preferred that the antenna elements 10*a* and 10*b* are arranged such that they face in opposite directions. Further, additional pattern modifying shorted posts can be added to the ground plane to enhance performance in certain directions. Also as shown in FIG. 4*g* the dielectric 15 on which the parasitic element 14 and the radiating element 12 are mounted includes a tab 19. The ground plane includes a corresponding slot 17 into which the tab 19 is inserted. The parasitic element 14 covers the tab 19 and as a result when the tab 19 is inserted in the slot 17 the parasitic element is available to the side opposite the side on which the antenna element is mounted. This facilitates the grounding the of the parasitic element and also provides additional structural support. The pin 16 extends through the hole 18 and is preferably soldered to parasitic element.

As shown in FIG. 4(*h*) the antenna array 44 is preferably mounted in a frame 72 and protected by a cover 73. The frame can be used as a ground and as the method for installing on traffic light poles 75 (FIG. 6) and other existing structures such as street light poles.

Figure 5A:
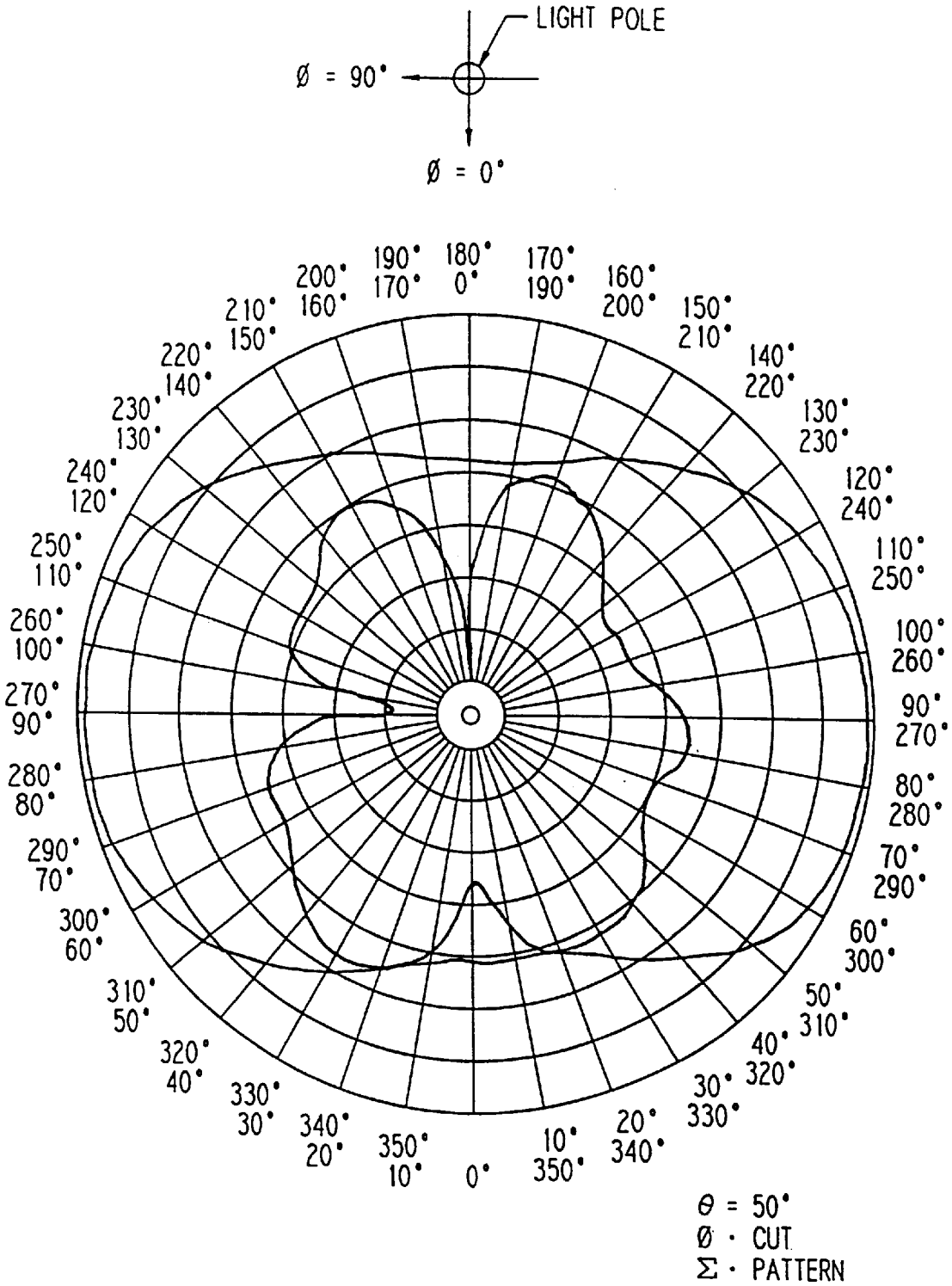
FIGS. 5(*a*) and 5(*b*) illustrate radiation patterns in the azimuth and elevation planes, respectively, at a summing port of a dual pattern diversity folded mono-bow antenna array in accordance with one form of the present invention.
Figure 5B:
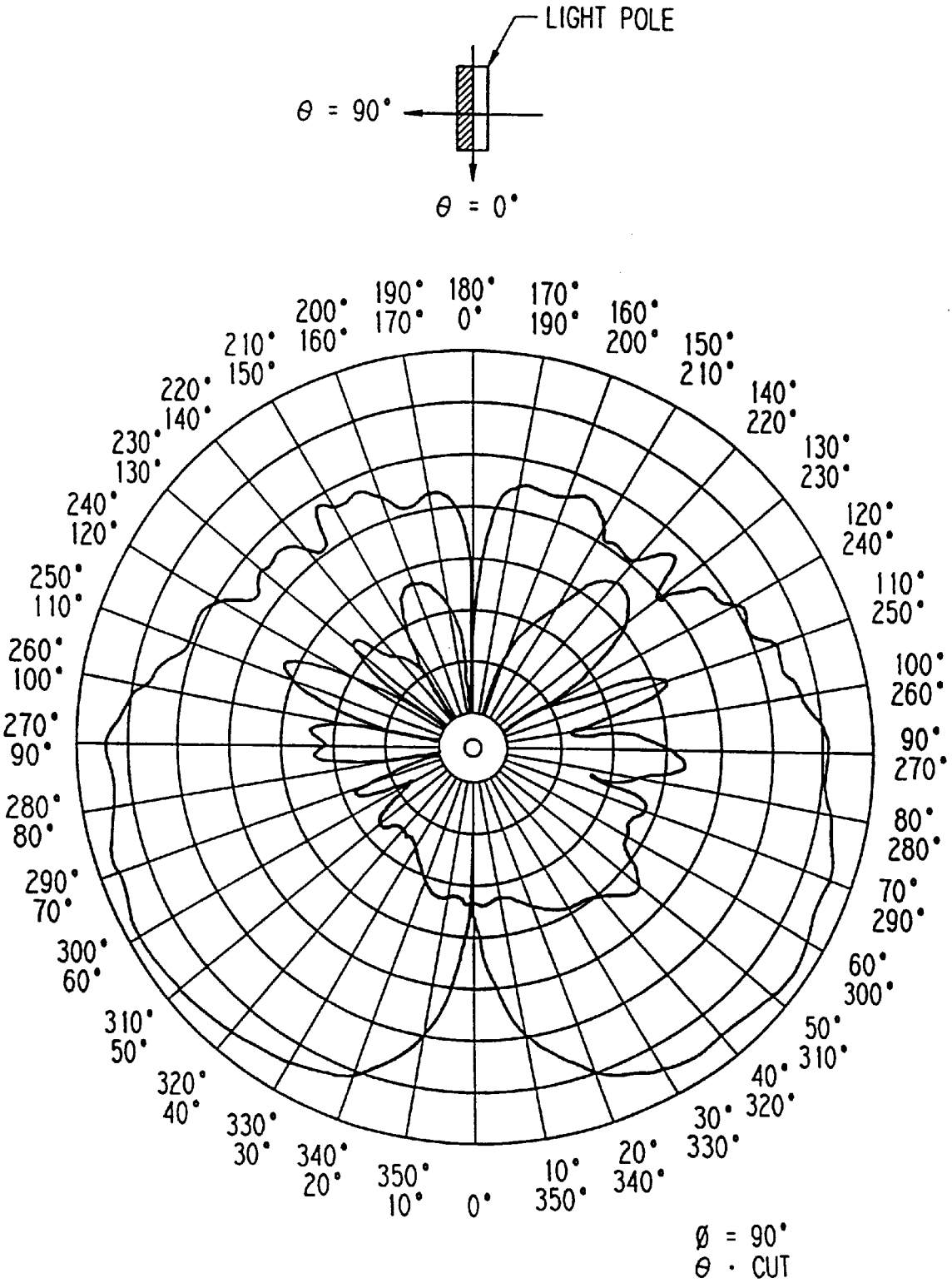

Exemplary radiation patterns for the summing port 50*b* of the dual pattern diversity folded mono-bow antenna array 44 described above are shown in FIGS. 5(*a*) and 5(*b*). As shown in FIG. 5(*a*), the in phase summation of the energy from the two antenna elements 10*a* and 10*b* at the hybrid summing port 50*b* results in a reduced azimuth beam width, dual direction radiation pattern with peaks at $\phi=90°$ and 270°, and nulls at $\phi=+/-90°$. Stated somewhat differently, the horizontal radiation pattern for the summing port 50*b* shows maximum gain in directions orthogonal to the central axis 47 of the antenna array 44 and reduced gain along the central axis 47 of the antenna array 44. In addition, as shown in FIG. 5(*b*), the elevation radiation pattern for the summing port 50*b* shows peak gains at $\Theta=50°$ and 310°.

Though not shown, the horizontal radiation pattern for the difference port 50*a* of the dual pattern diversity folded mono-bow antenna array 44 is effectively the complement of the radiation pattern for the summing port 50*b*. Moreover, the out-of-phase summation of the energy from the two antenna elements 10*a* and 10*b* at the hybrid difference port 50*a* results in a reduced azimuth beam width, dual direction radiation pattern with peaks at $\phi=0°$ and 180°.

Figure 6:
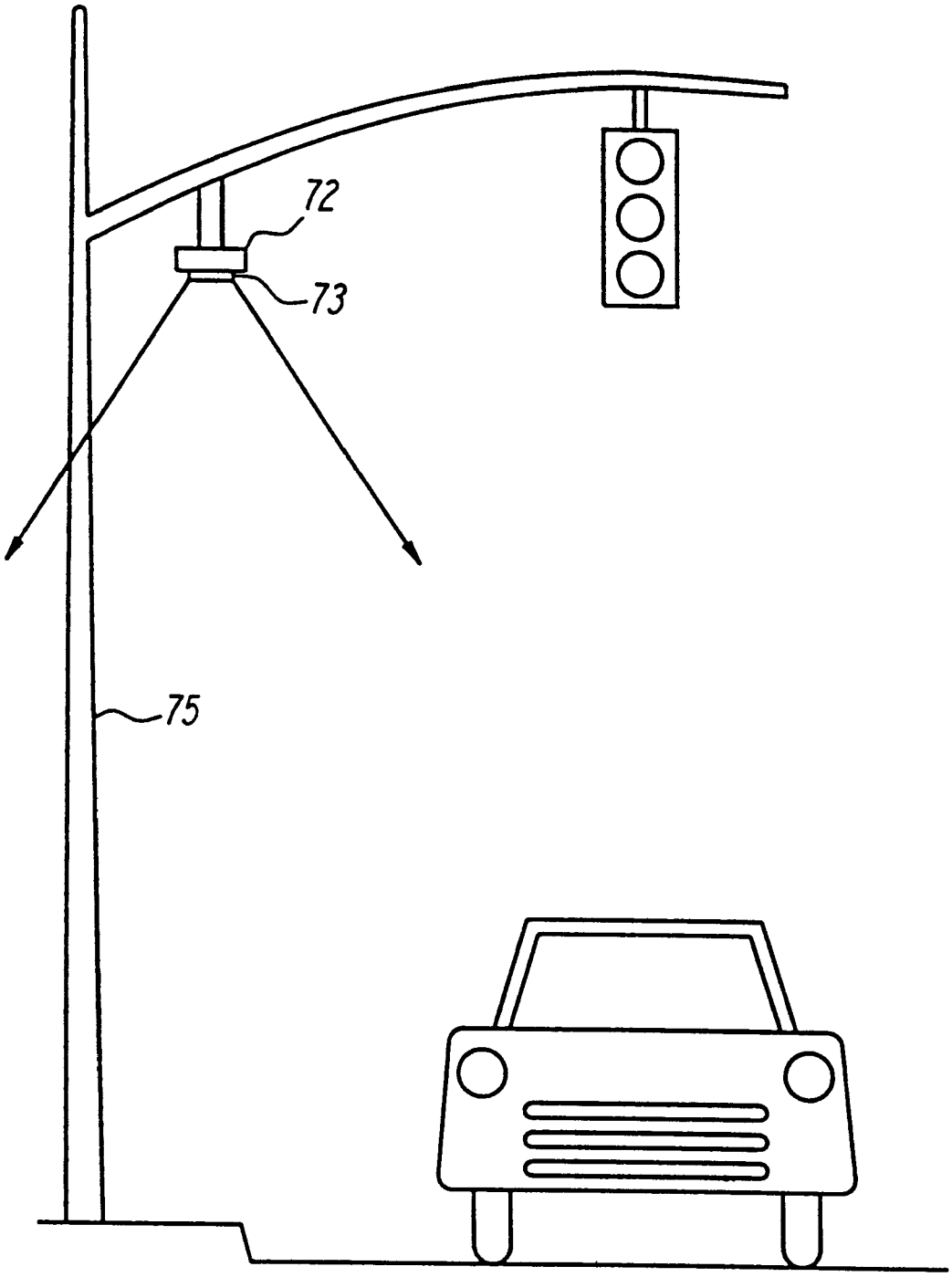
FIG. 6 illustrates a preferred deployment of a dual pattern diversity folded mono-bow antenna in accordance with the present invention.

Given the above described properties of the radiation patterns of a dual pattern diversity folded mono-bow antenna array 44 in accordance with the present invention, it is clear that such an array is well suited for mounting on light poles (or other similar structures) within a dense urban environment. The reason for this is that the nulls in the horizontal radiation pattern of, for example, the summing port 50*b* of the antenna array 44 may be directed to the light pole on which the antenna array 44 is mounted, thus, minimizing multipath (i.e., beam reflections) emanating from the light pole. This multipath rejection capability effectively eliminates a need to mount the antenna array 44 at any substantial distance from an associated light pole (or other supporting structure) and, therefore, provides for very compact installation within an urban (or other) environment. Further, if the antenna elements 10*a* and 10*b* are arranged in a downward facing direction (i.e., extend from the ground plane 46 in the direction of the street in an urban environment), channeling within an urban canyon is minimized. The reason for this is that the antenna array 44, when deployed in a downward facing direction, directs the majority of its energy toward the user level on the street, has reduced gain at the horizon and provides a null region close to the installation to reduce interference from portable units directly beneath the installation. This is shown in FIG. 6.

Four Beam Monopole Diversity Antenna Arrays

Figure 7A:
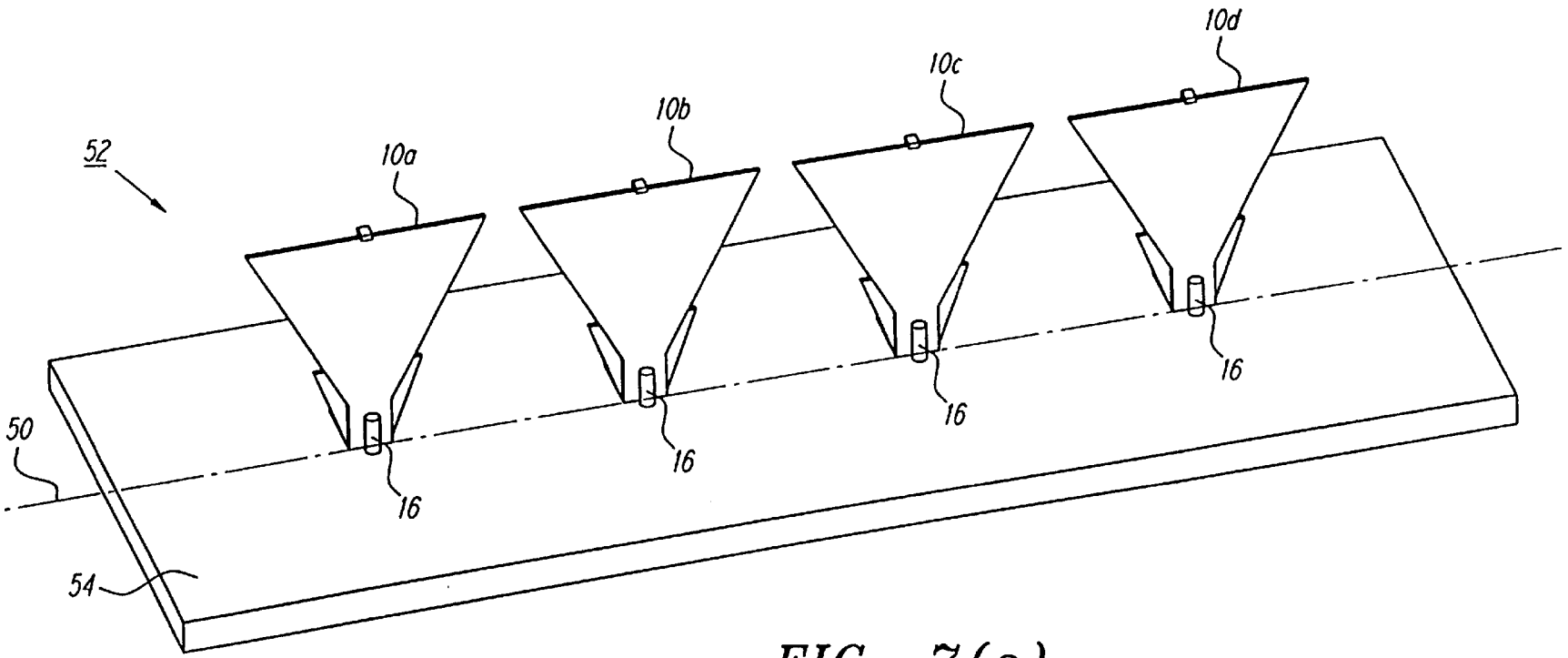
FIG. 7(*a*) illustrates a preferred 4-beam monopole diversity antenna array in accordance with the present invention.
Figure 7B:
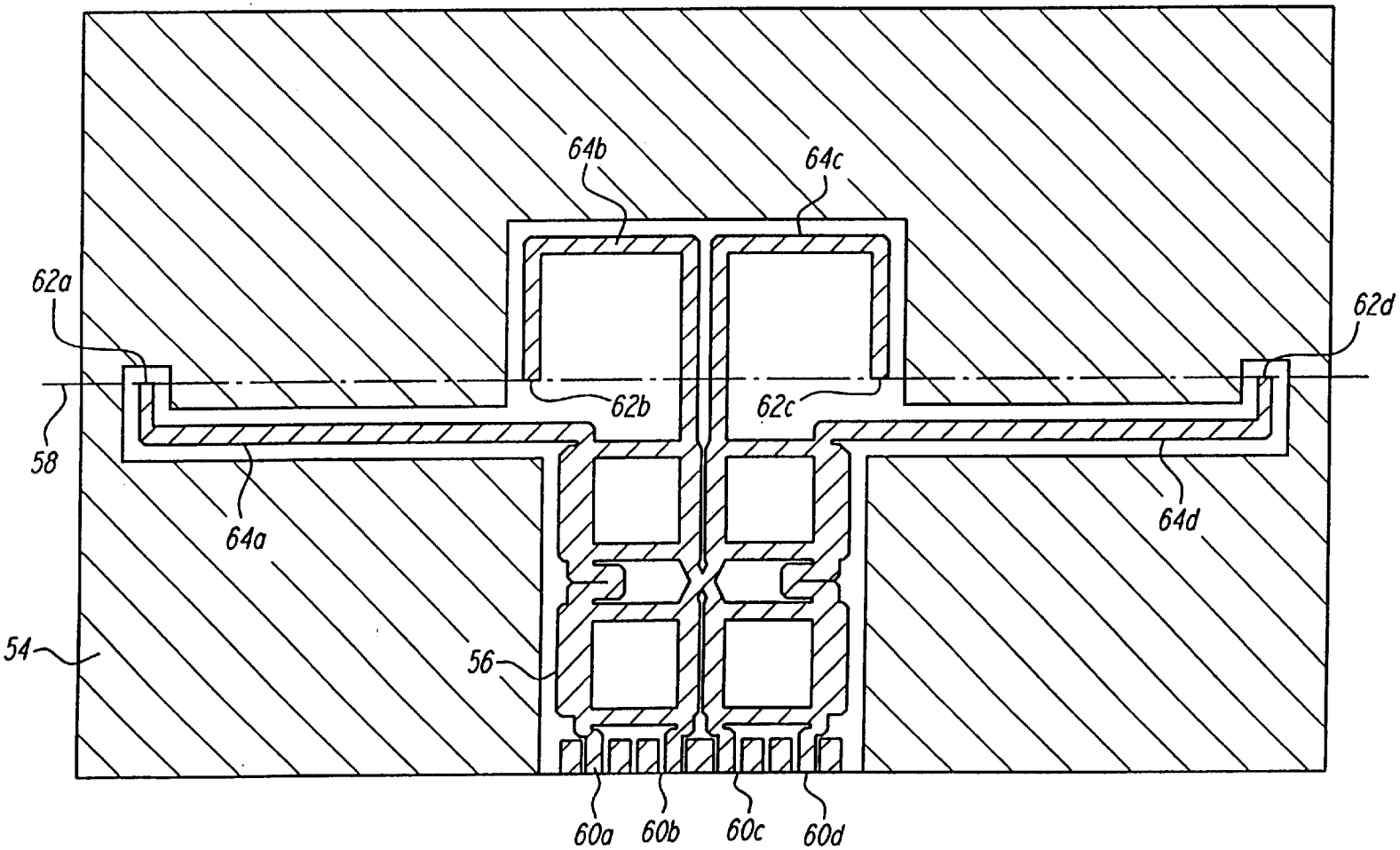
Figure 7C:
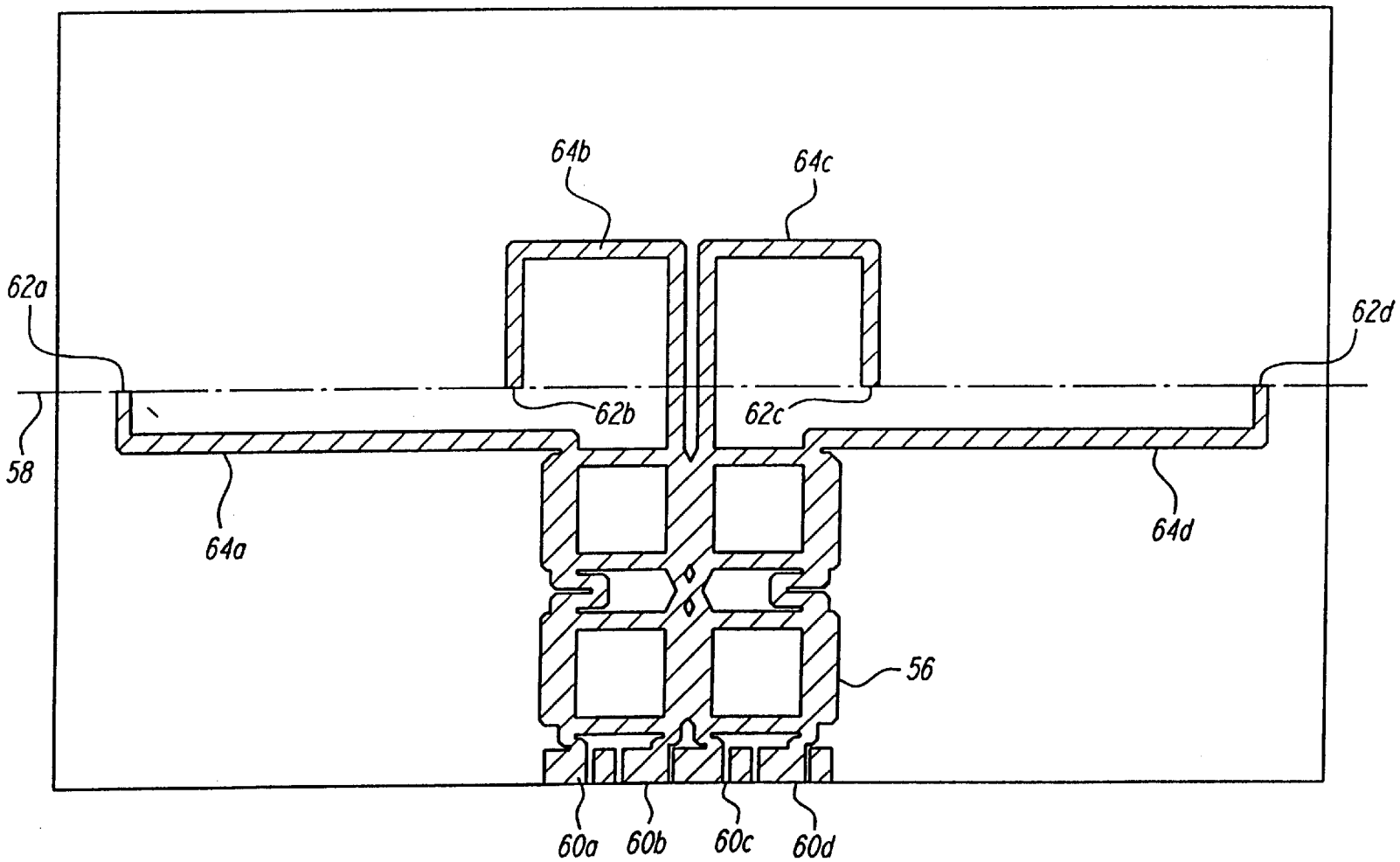

In another innovative aspect, the present invention is directed to the implementation, manufacture and use of four beam monopole diversity antenna arrays. Moreover, as shown in FIGS. 7(*a*) and 7(*b*), a four beam monopole diversity antenna array 52 in accordance with the present invention preferably comprises four folded mono-bow antenna elements 10*a*–10*d*, such as those described above, a common ground plane 54 and a butler matrix combiner/splitter circuit 56. In a preferred form, the common ground plane 54 comprises a printed circuit board substrate having opposing coplanar surfaces (i.e. a top surface and a bottom surface) whereon respective layers of copper cladding are deposited. The butler matrix combiner/splitter circuit 56, shown in FIG. 7(*b*), are preferably formed by etching away portions of the copper cladding deposited on one of the surfaces of the printed circuit board substrate. As explained above, the copper cladding layer deposited upon the top surface of the printed circuit board substrate and portions of the copper cladding layer deposited on the bottom surface of the printed circuit board substrate are preferably electrically connected by a series of plated through-holes (not shown) formed in the printed circuit board substrate. A standard type N coax connector is provided at each of the input ports 60*a*–60*d* of the butler matrix combiner/splitter circuit 56, and the tips 62*a*–62*d* of the antenna feed lines 64*a*–64*d* are connected to respective feed pins (not shown) which extend through insulated holes (not shown) formed in the common ground plane 54 and are coupled to the mono-bow antenna elements 10*a*–10*d*. Presently preferred dimensions of the metal traces comprising the butler matrix combiner/splitter circuit 56 areas follows: Lines 64*a* and 64*d* are preferably spaced 600 mils from the centerline 58. Preferably the center to center spacing between lines 62*a* and 62*b*, between lines 62*b* and 62*c* and between 62*c* and 62*d* is 3.1 inches. Preferably lines 64*b* and 64*c* are 1362.5 mils. Preferably the traces are 59 mils wide and preferably the ground plane id 7" by 14.3".

As shown in FIG. 7(*a*), the folded mono-bow antenna elements 10*a*–10*d* may be mounted along a central axis 58 of the common ground plane 56 and should be separated by a distance substantially equal to ½ of the wavelength of the radio frequency waves to be transmitted and received by the antenna array 52. As it is presently preferred that the folded mono-bow antenna elements 10*a*–10*d* provide for optimal transmission and reception at a frequency of 1920 MHZ, adjacent folded mono-bow antenna elements are, preferably, separated by a distance of substantially 3.3 inches. It is also presently preferred that the common ground plane 54 be substantially rectangular in shape, have a width of substantially 7.0 inches and have a length of substantially 14.3 inches. However, it should be appreciated that by varying the dimensions of the common ground plane 54 it is possible to vary the radiation pattern of the antenna array 52 to address the system design goals of a given installation site. Moreover, depending upon the design goals of a given installation, it may be desirable to the dimensions of the ground plane 54, the dimensions of the folded mono-bow antenna elements 10*a*–10*d* may be modified in accordance with the teachings presented here or, perhaps, in some circumstances to substitute some other type of antenna (for example, another type of monopole antenna) for the antenna elements 10*a*–10*d* described above.

Figure 8:
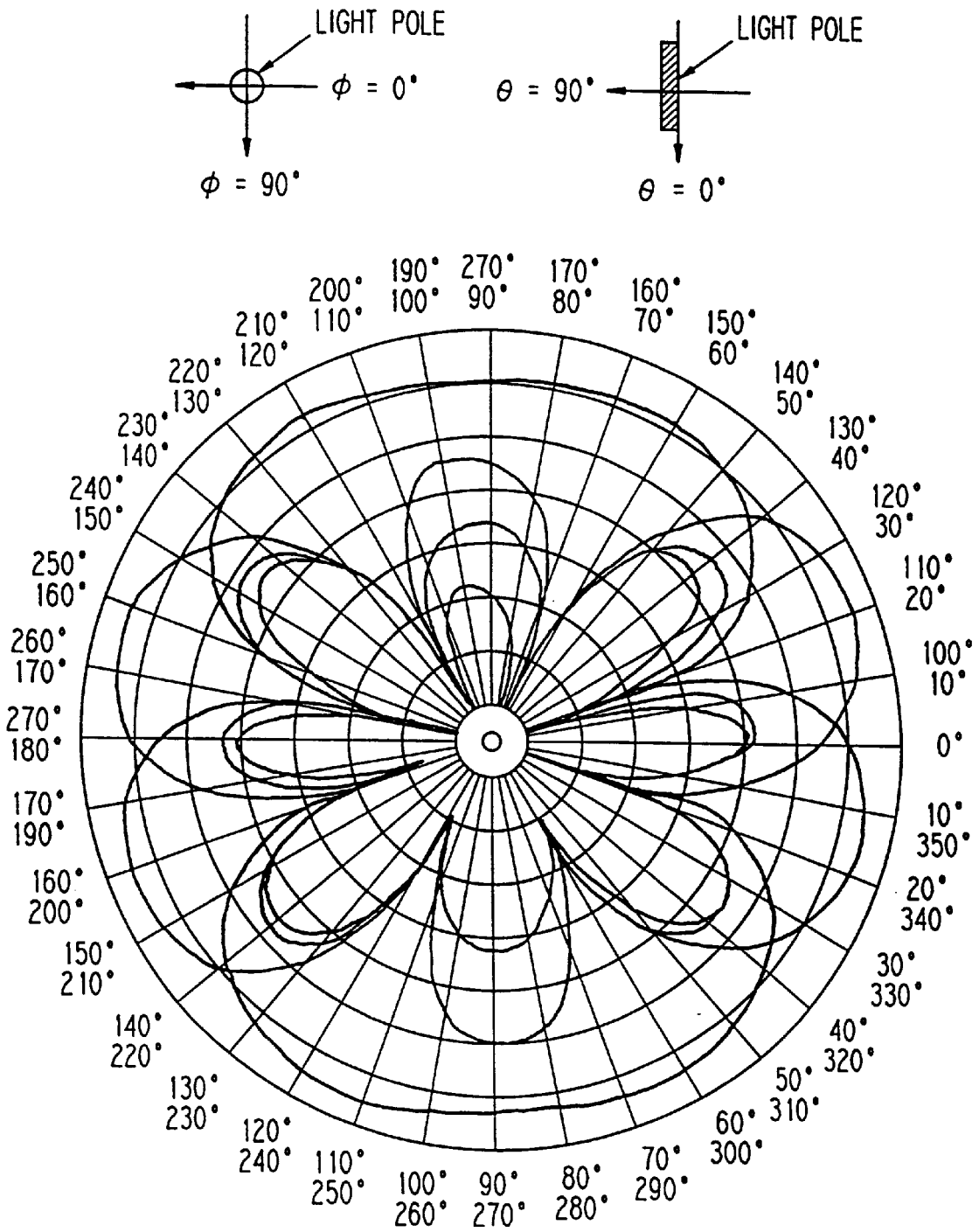
FIG. 8 provides an exemplary illustration of the radiation pattern of the energy at the summing ports of the butler matrix utilized in accordance with the 4-beam monopole diversity antenna array shown in FIGS. 7(*a*)–7(*c*).

Turning now to FIG. 8, the summation of the energy from the four folded mono-bow antenna elements 10*a*–10*d* at each of the butler matrix input ports 60*a*–60*d* results in a narrow azimuth beam width, dual directional radiation pattern with peaks at approximately $\phi$=13.5°, 40.5°, 116.5°, 193.5°, 220.5° and 319.5° in the horizontal plane. Thus, it will be appreciated that, using a four beam monopole diversity antenna array 52 in accordance with the present invention, it is possible to achieve a bi-directional pattern in the horizontal plane, while simultaneously providing multi-pattern diversity. This makes a four beam monopole diversity antenna array 52, such as that described above, well suited for use within communications systems which use pattern diversity to achieve multipath mitigation. Because the gain in the elevation plane of the antenna elements 10*a*–10*d* comprising the antenna array 52 may be varied depending upon the dimensions of the common ground plane 54, the antenna array 52 may also be used to combat channeling in an urban canyon.

Dual Polarized 4-Way Diversity Antenna Arrays

Figure 9:
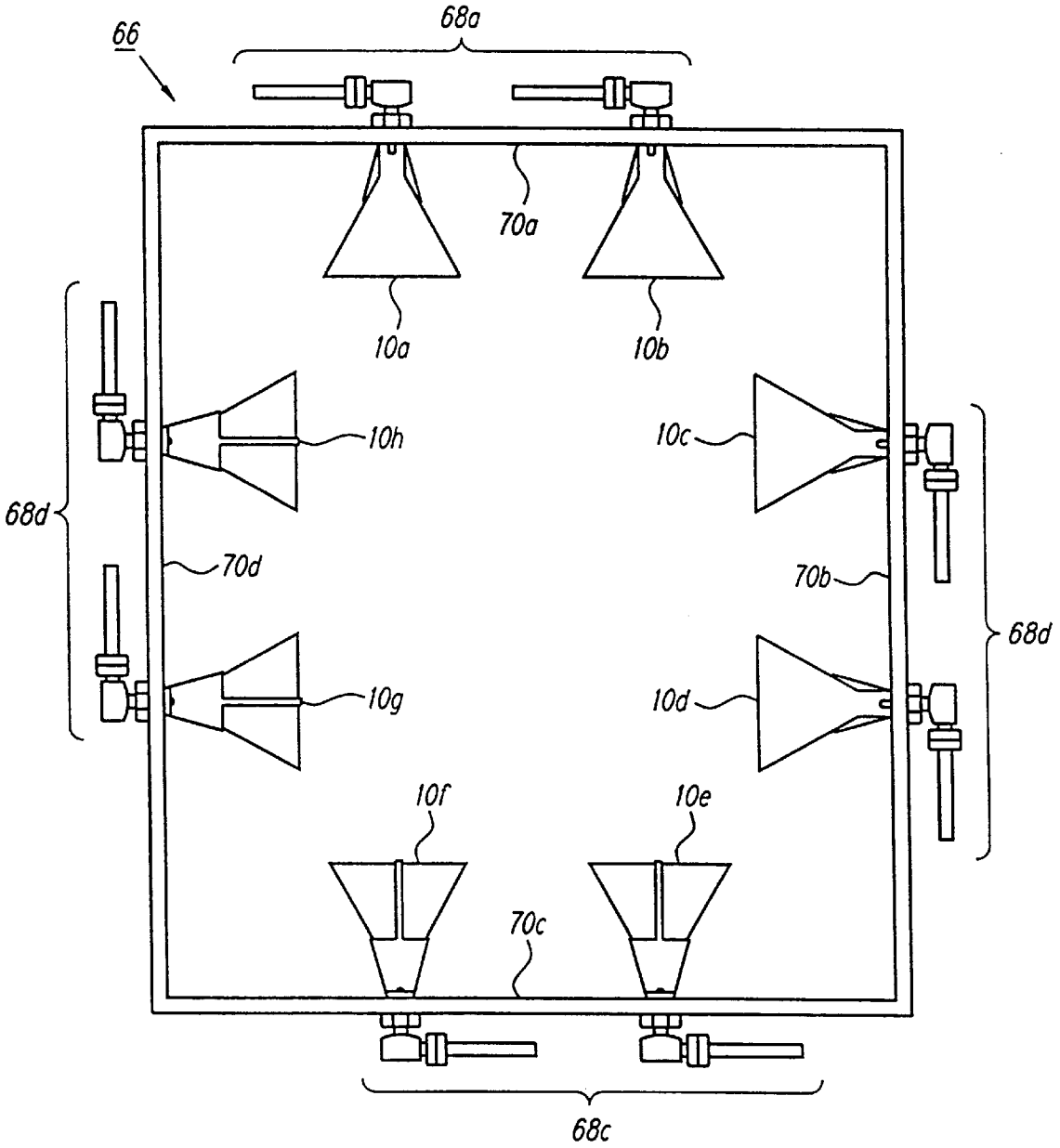
FIG. 9 is an illustration of a preferred dual polarized 4-way diversity antenna array in accordance with the present invention.

In still another innovative aspect, the present invention is directed to the implementation, manufacture and use of dual polarized 4-way diversity antenna arrays. As shown in FIG. 9, a dual polarized 4-way diversity antenna array 66 in accordance with the present invention preferably comprises four antenna modules 68*a*–68*d* wherein each of the antenna modules comprises a dual pattern diversity folded mono-bow antenna array (such as the array 44 described above), and wherein the four antenna modules 68*a*–68*d* generally form a parallel piped structure with respective pairs of the antenna modules 68*a*–68*d* being arranged in an opposing and parallel orientation. While the antennas 10*a*–10*h* comprising the dual polarized 4-way diversity antenna array 66 shown in FIG. 9 are shown as being fed by conventional coax connectors which, in turn, may be coupled to a set of 0° combiner/splitter circuits, "Tee" splitters or Wilkinson™ power dividers (not shown), a plurality of 0° combiner/splitter circuits are preferably formed on the copper clad printed circuit board substrates which comprise the ground planes 70*a*–70*d* of the antenna modules 68*a*–68*d*.

By providing two antenna modules (i.e., antenna modules 68*a* and 68*c* or antenna modules 68*b* and 68*d*) in each polarization and by separating those modules by a distance of substantially one wavelength (6.6 inches in one preferred embodiment), it is possible to achieve a high degree of separation diversity within a dense urban environment. Further, since the effectiveness of various diversity schemes is multiplicative, the combination of separation diversity and polarization diversity provided by the dual polarized 4-way diversity antenna array 66 may provide a very powerful multipath mitigation tool.

As explained above, depending upon the design goals of a given installation according to the teachings presented herein, the dimensions of the ground planes 70*a*–70*d* (either collectively or independently may be modified; the dimensions of the folded mono-bow antenna elements 10*a*–10*h* used within the antenna modules 68*a*–68*d* may be modified; and in some circumstances some other type of antenna (for example, another type of monopole antenna) for the antenna elements 10*a*–10*h* described above may be utilized. Nonetheless, in one preferred form, the respective antenna modules 68*a*–68*d* include similar elements to those illustrated in FIGS. 4(*a*)–4(*c*) described above and, thus, each provide radiation at a respective summing port (not shown) which is substantially the same as that shown in FIGS. 5(*a*) and 5(*b*); when the ground planes 70*a*–70*d* of the respective antenna modules 68*a*–68*d* have substantially the same dimensions as the ground plane shown in FIGS. 4(*a*)–(*c*).

Omnidirectional Dual Pattern Diversity Antenna Arrays

Figure 10:
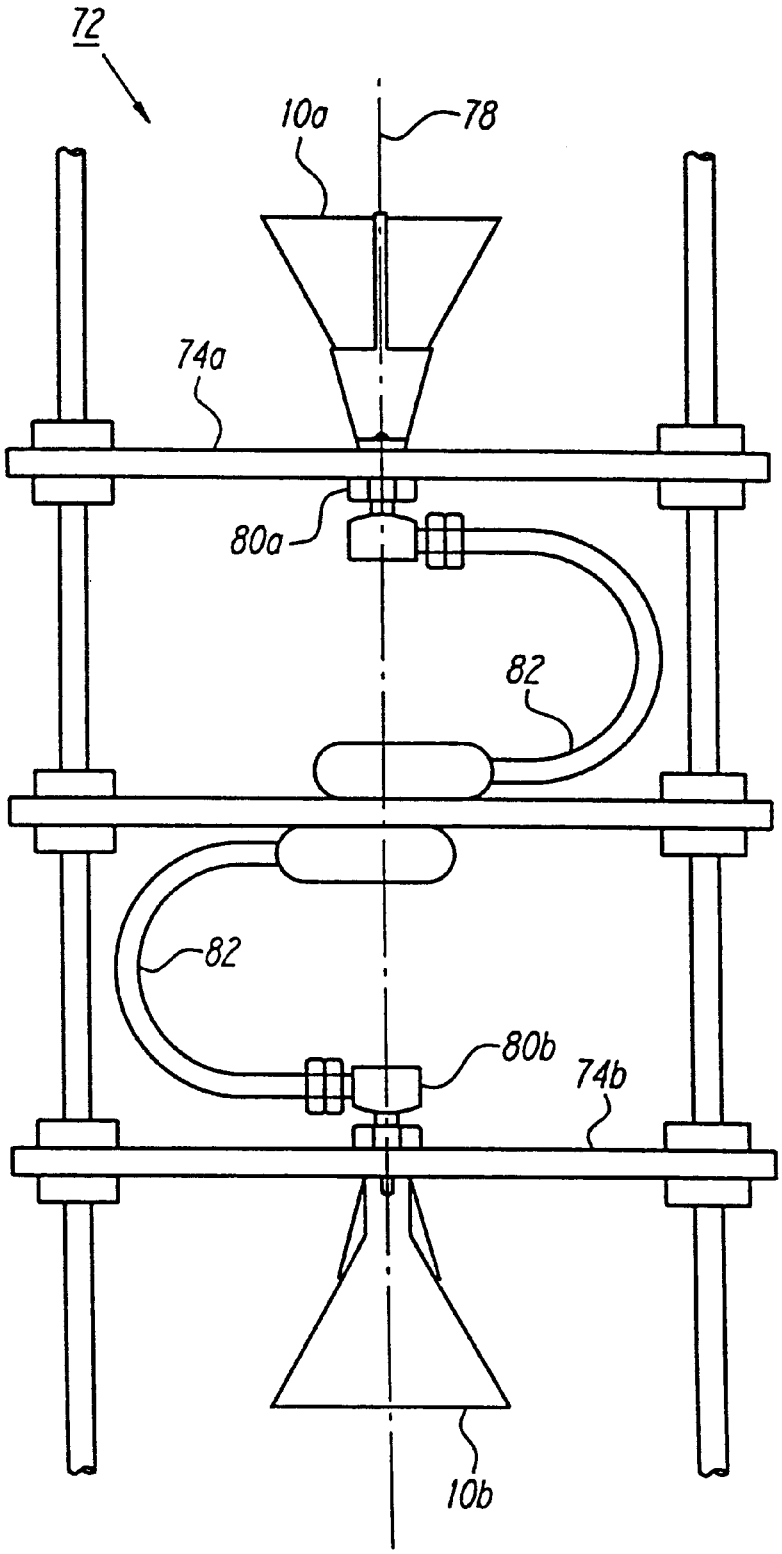
FIG. 10 is an illustration of a preferred omnidirectional dual pattern diversity antenna array in accordance with the present invention.

In still another innovative aspect, the present invention is directed to the implementation, manufacture and use of omnidirectional dual pattern diversity antenna arrays. Moreover, as shown in FIG. 10, an omnidirectional dual pattern diversity antenna array 72 in accordance with the present invention preferably comprises two folded mono-bow antenna elements 10*a* and 10*b* which are mounted to respective ground planes 74*a* and 74*b* and connected to a 180° hybrid combiner network (not shown) . The folded mono-bow antenna elements 10*a* and 10*b* are preferably oriented along a common vertical axis 78, are preferably separated by one half of a selected wavelength (i.e., separated by substantially 3.3 inches in one preferred form), and are oriented in contra-direction with respect to one another.

In one preferred form, the ground planes 74*a* and 74*b* has a substantially square shape and measures substantially 4.0 inches on a side. Further, if SMA connectors 80*a* and 80*b* are used to provide an interface to the folded mono-bow antenna elements 10*a* and 10*b*, a relatively short, phase matched length of coaxial cable 82 is preferably used to connect each of the antenna elements 10*a* and 10*b* to the output ports (not shown) of the 180° hybrid combiner network (not shown). In contrast, if the antenna interfaces are provided by feed pins (not shown) soldered to the element feed points (not shown) of a pair of microstrip transmission lines (not shown) formed on the printed circuit board substrates comprising the respective ground planes 74*a* and 74*b*, then a short length of coaxial cable may be soldered to the microstrip transmission lines (not shown) and to the output ports (not shown) of the 180° hybrid combiner network. The input ports (not shown) of the 180° hybrid combiner network may be terminated with suitable RF connectors (for example, type N coax connectors).

Figure 11A:
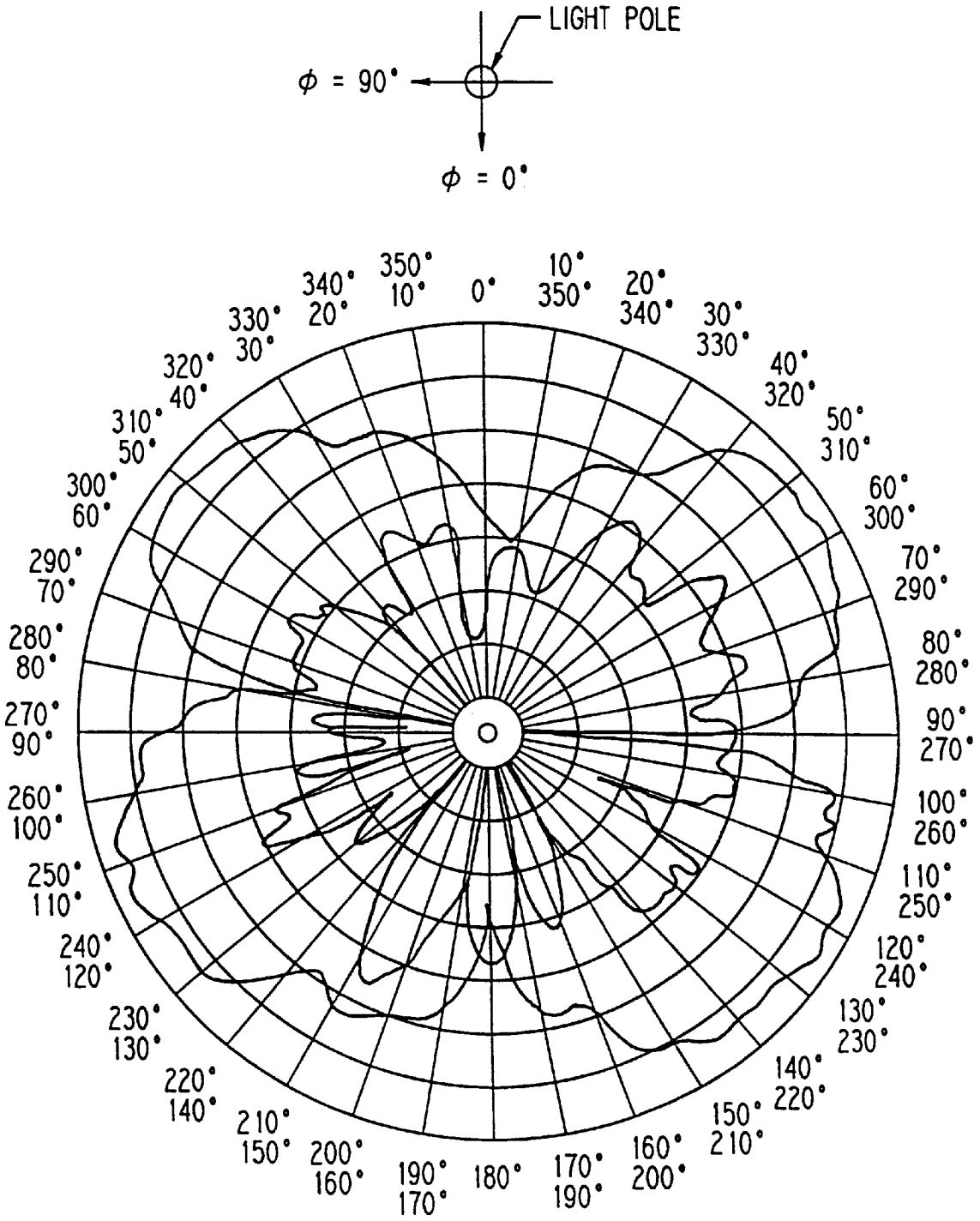
FIGS. 11(*a*) and 11(*b*) provide exemplary illustrations of the radiation patterns at the summation and difference ports, respectively, of the 180° hybrid combiner network depicted with the omnidirectional dual pattern diversity antenna array shown in FIG. 10.
Figure 11B:
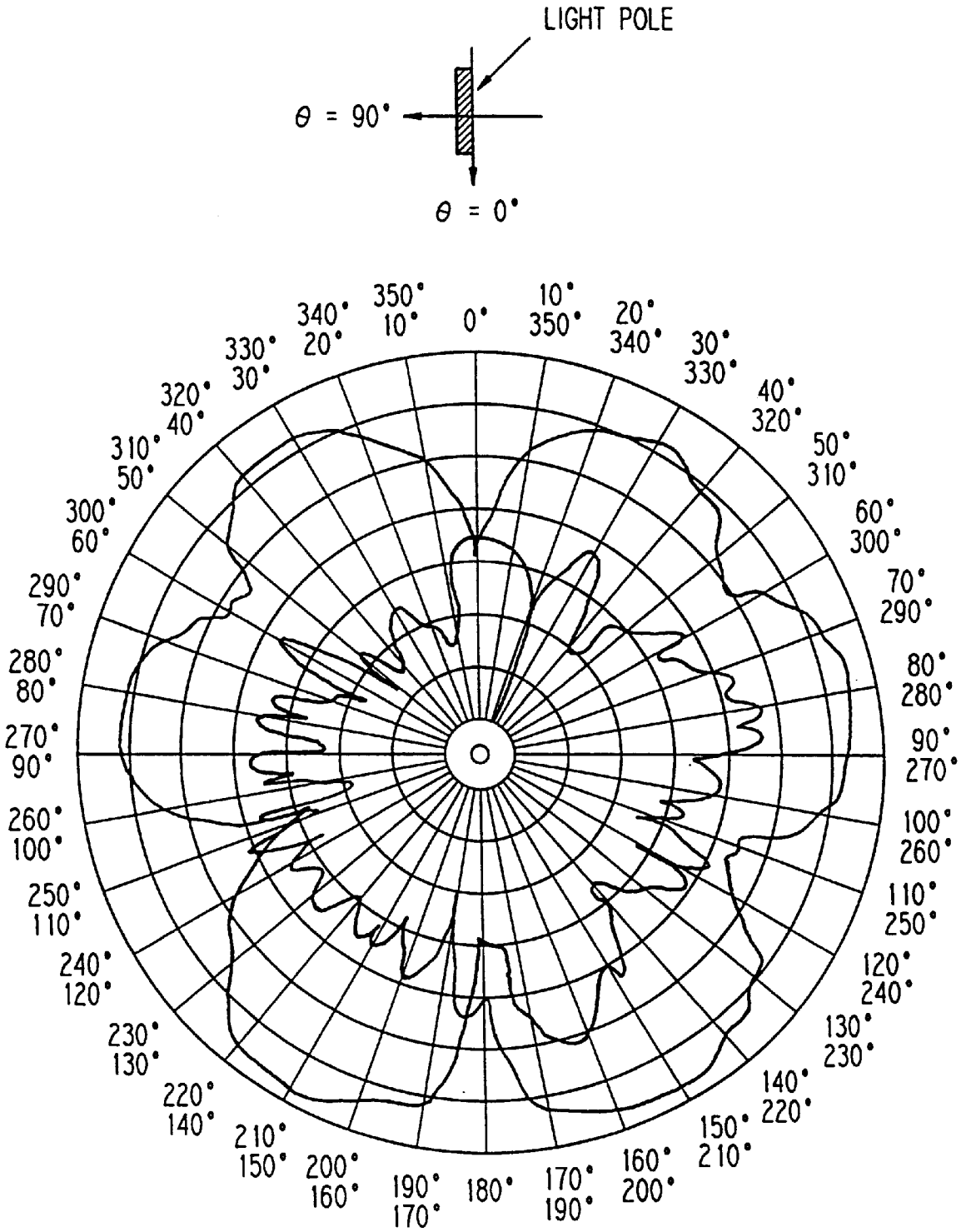

Turning now also to FIGS. 11(*a*) and 11(*b*), when the energy received by two contra-directional folded mono-bow antenna elements 10*a* and 10*b* is combined using the 180° hybrid combiner network, the radiation pattern of the array 72 takes on two substantially separate orthogonal shapes in the elevation plane. Moreover, the in-phase summation of the energy from the two folded mono-bow antenna elements 10*a* and 10*b* at the combiner (i.e., summation) port produces a radiation pattern having four main lobes at approximately $\Theta$=60°, 120°, 240° and 300° that are substantially omnidirectional in $\phi$ and null at $\Theta$=+/−90°. At the difference port, the energy sums to produce six main lobes at about $\Theta$=+/−30°, +/−90°, and +/−150° which also are substantially omnidirectional in $\phi$.

By using two omnidirectional dual pattern diversity antenna arrays, such as those described above, with greater than one wavelength spacing in the horizontal plane, it is possible to achieve a 4-way diversity scheme which employs both separation and pattern diversity methodologies. Again, because diversity schemes, or methodologies, are multiplicative in effect, the use of omnidirectional dual pattern diversity antenna arrays, such as those described and claimed herein, may provide a powerful tool for multipath mitigation and building penetration in a dense urban environment. However, it should be understood that the antenna elements and antenna arrays described and claimed herein are by no means limited to applications within dense urban environments.

Dual Polarized Bi-Directional Diversity Antenna Arrays

Turning now to FIGS. 12(*a*)–(*c*), in still another innovative aspect the present invention is directed to the implementation, manufacture and use of dual polarized bi-directional diversity antenna arrays. As shown in the figures, a dual polarized bi-directional diversity antenna array 100 preferably comprises a pair of folded mono-bow antenna elements 210*a* and 210*b*, a common ground plane 101, a pair of "T" shaped dipole antenna elements 102*a* and 102*b*, four director elements 104*a–d,* a first microstrip feed line 106 for the folded mono-bow antenna elements 210*a* and 210*b*, and a second microstrip feed line 108 for the "T" shaped antenna elements 102*a* and 102*b*. The common ground plane 101 may comprise a printed circuit board substrate having opposing coplanar surfaces (i.e. a top surface and a bottom surface) whereon respective layers of copper cladding are deposited, and the microstrip feed lines 106 and 108 are preferably formed by etching away portions of the copper cladding deposited on, for example, the bottom surface of the printed circuit board substrate. In addition, the copper cladding layer deposited upon the top surface of the printed circuit board substrate and portions of the copper cladding layer deposited on the bottom surface of the printed circuit board substrate (not including those portions of the copper cladding layer which comprise the microstrip feed lines 106 and 108) are preferably electrically connected by a series of plated through-holes 109 formed in the printed circuit board substrate which are also used to secure the ground plane to the enclosure. Additionally an array of small perforations (not shown) are distributed around the periphery 119, on the ground pads 115 and the cable grounding pads 113 to act as ground vias. This insures that the respective copper cladding layers form a single, unified ground plane. The microstrip feed lines 106 and 108 are preferably coupled at the conductor pads 111 respectively to a pair of coaxial cables 110 and 112, and the coaxial cables 110 and 112 are preferably in turn be coupled to standard type N coax connectors 114 and 116 sized, for example, to receive 0.875 inch diameter cable.

Figure 12A:
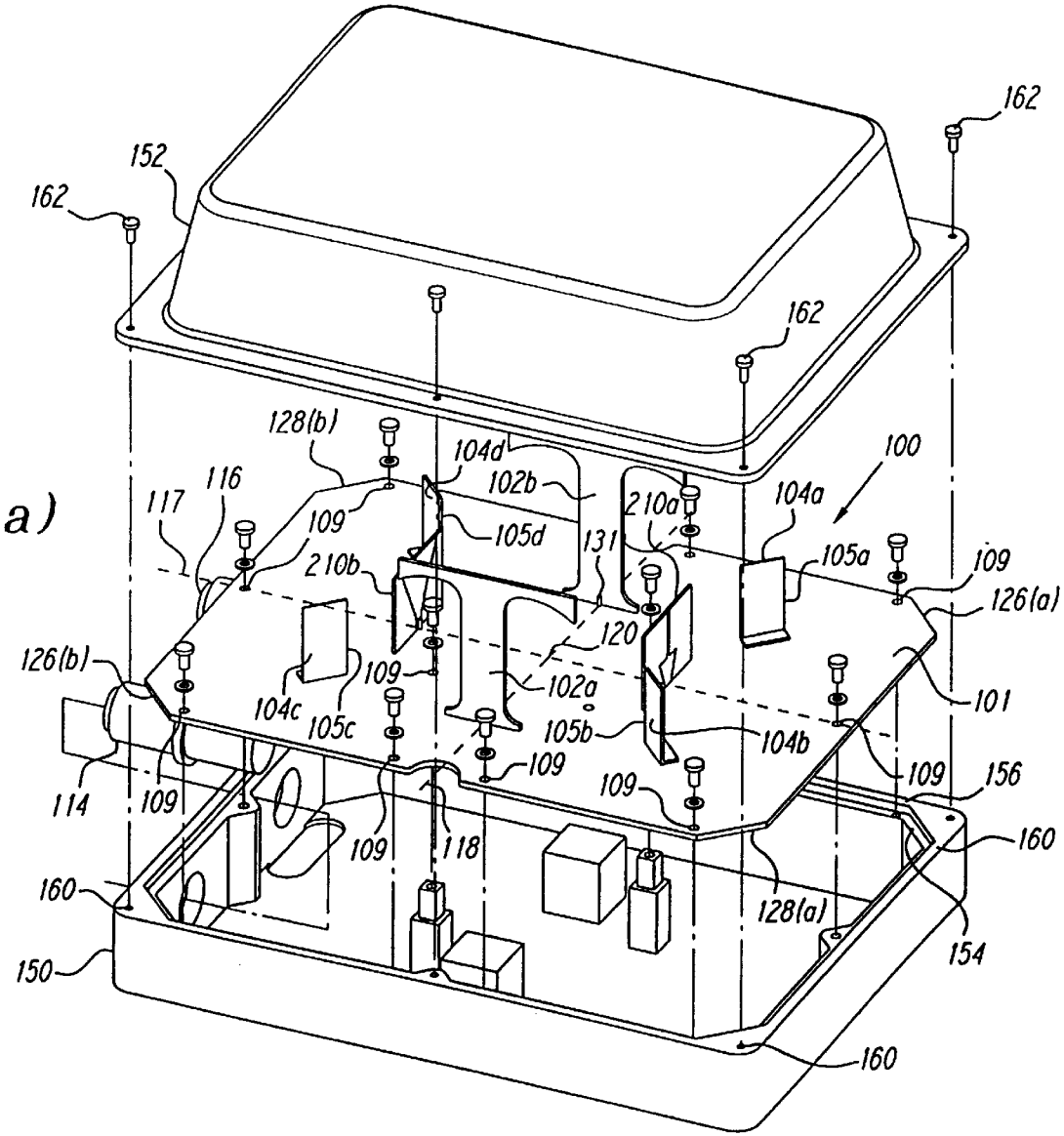
FIG. 12(*a*) illustrates a preferred dual polarized bi-directional diversity antenna array in accordance with the present invention.
Figure 12B:
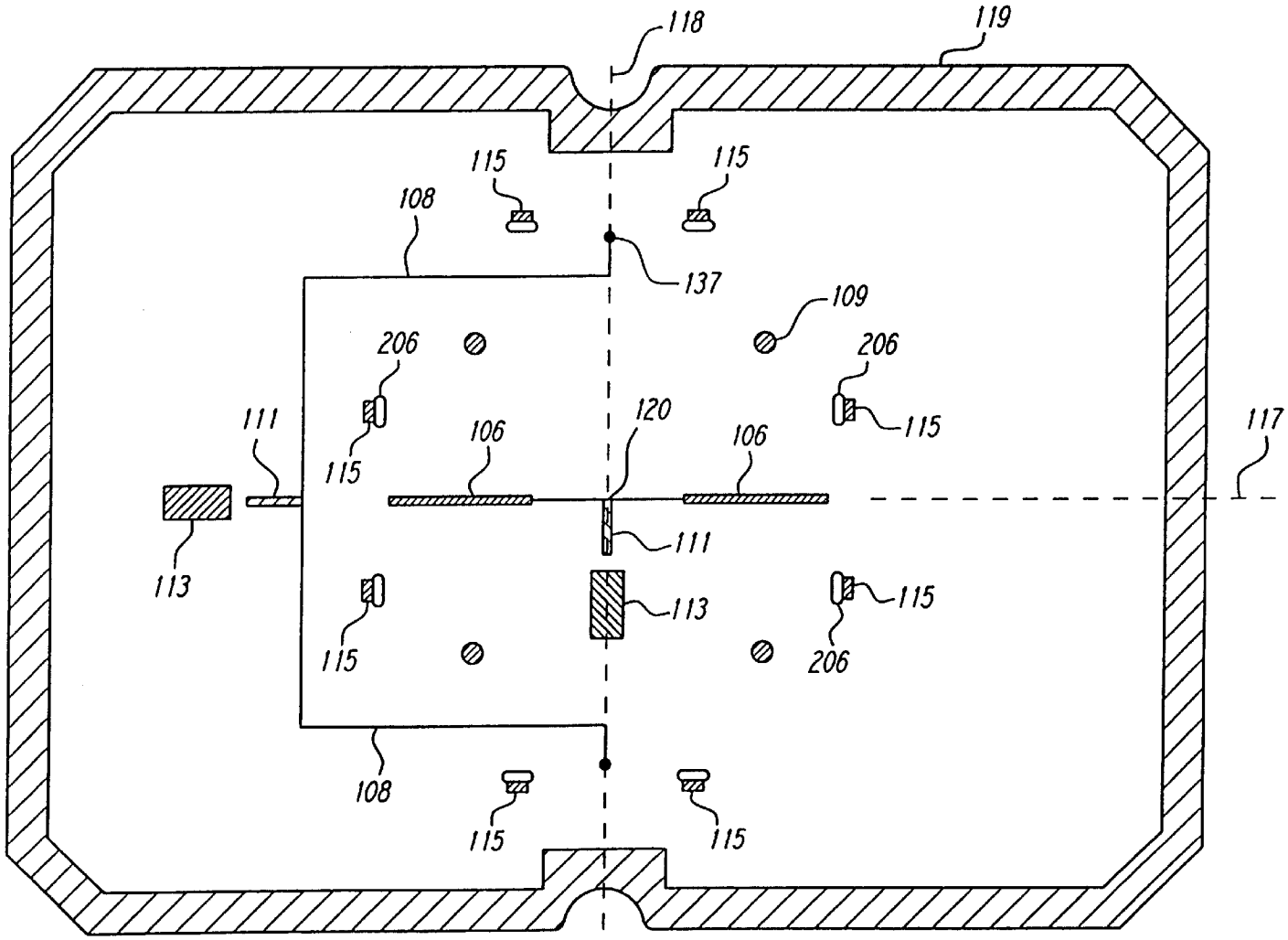
Figure 12C:
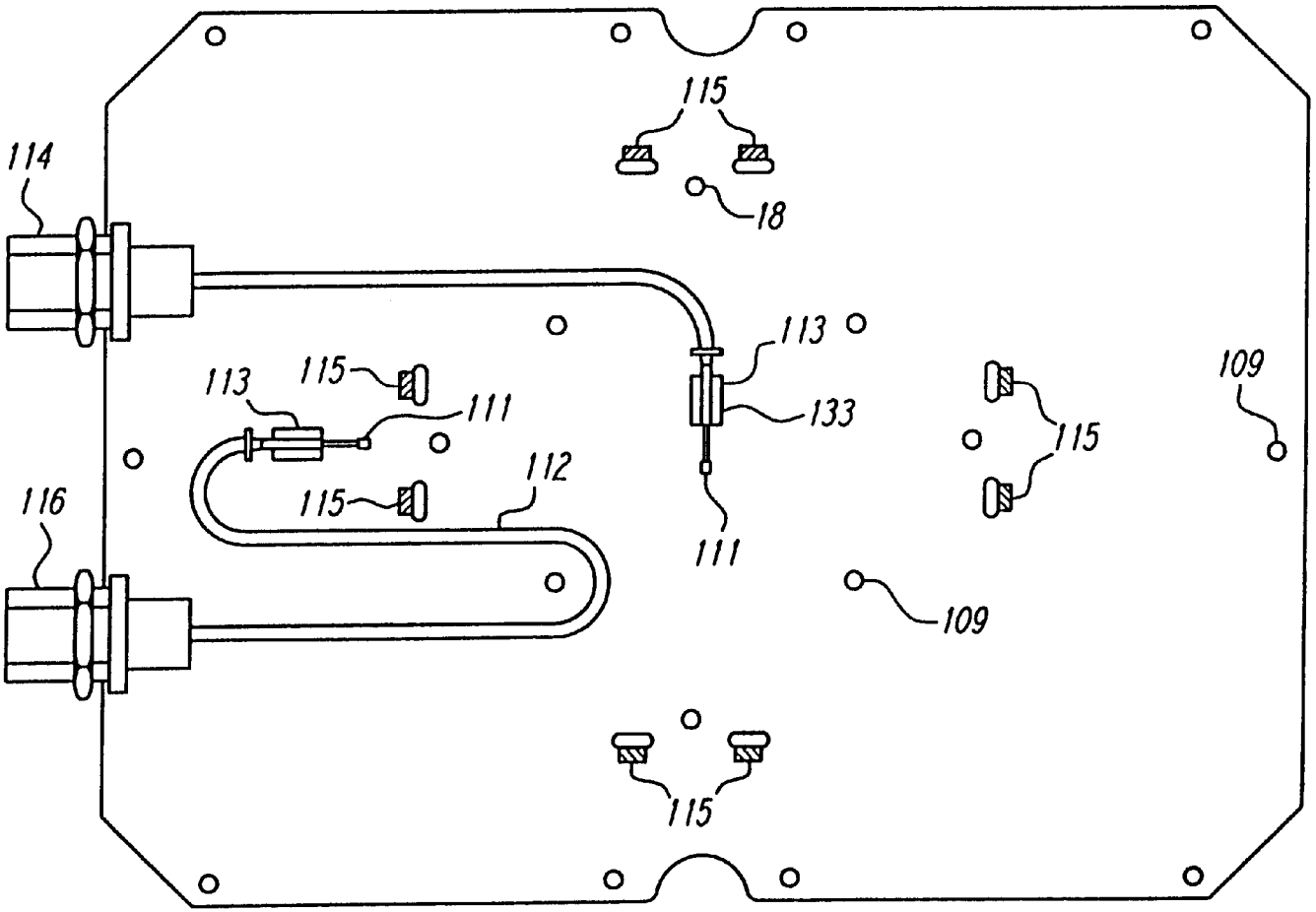
Figure 12D:
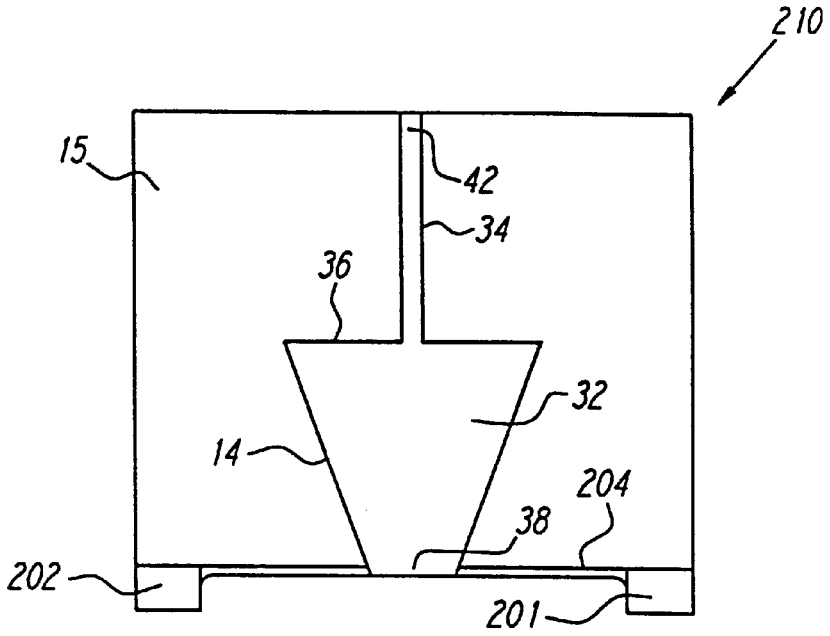
Figure 12E:
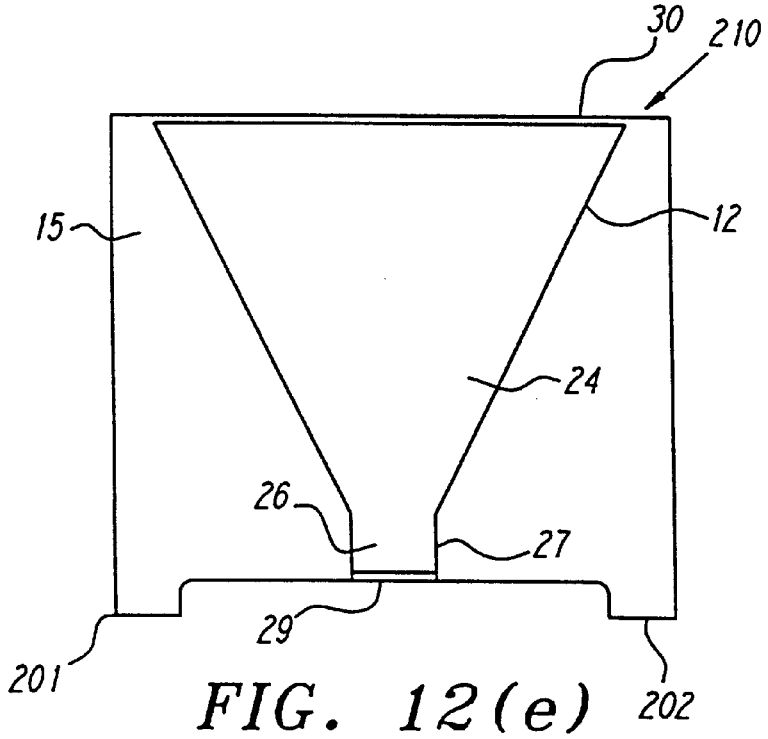

The presently preferred folded mono-bow element 210 as shown in FIGS. 12*d* and 12*e* include the same components as the elements described with regard to FIGS. 2(*a*) and (*b*) bearing the same numeral designation. Further two tabs 201 and 202 are used for mounting and grounding. These tabs extend through the slots 206 and are soldered to the grounding pads 115 and the top surface of the grounding plane.

Turning back to FIG. 12(*a*), the folded mono-bow antenna elements 210*a* and 210*b* are preferably mounted along a first axis 117 of the common ground plane 101 with the antenna elements facing each other and the "T" shaped antenna elements 102*a* and 102*b* are preferably mounted along a second axis 118 of the common ground plane 101 with the microstrip feed lines facing each other, the first axis 117 and the second axis 118 being orthogonal to one another and intersecting at a center point 120 of the common ground plane 101. As explained above, the folded mono-bow antenna elements 210*a* and 210*b* are preferably separated by a distance approximately equal to ½ of the wavelength of the radio frequency waves to be transmitted and received by the antenna array 100. Similarly, the "T" shaped antenna elements 102*a* and 102*b* are preferably separated by a distance approximately equal to ½ of the wavelength of the radio frequency waves to be transmitted and received by the antenna array 100. Thus, as it is presently preferred that the antenna array 100 provide for optimal transmission and reception at a frequency of 1710 to 1990 MHZ, the folded mono-bow antenna elements 210*a* and 210*b* are, preferably, separated by a distance of substantially 3.3 inches, as are the "T" shaped antenna elements 102*a* and 102*b*.

As for the director elements 104*a–d,* it is presently preferred that those elements comprise metal angles having a directing surface extending orthogonally from the common ground plane 101 and measuring 1.0 inch in height and 0.5 inch in width. The director elements 104*a–d* are mounted in first and second planes (not shown), which are preferably orthogonal to the common ground plane 101 and pass through opposing corners 126*a* and *b* and 128*a* and *b* of the common ground plane 101. It is also presently preferred that the inside edges 105*a–d* of the director elements 104*a–d* be located at a distance of substantially 2.4 inches from the center point 120 of the common ground plane 101.

As was the case with the dual pattern diversity antenna array 44 described above, it is presently preferred that the common ground plane 101 be substantially rectangular in shape, have a width of substantially 6.0 inches and have a length of substantially 8.0 inches. But again, it should be appreciated that by varying the dimensions of the common ground plane 101 it is possible to vary the radiation pattern of the antenna array 100 to meet (or attempt to meet) the system design goals of a given installation site. Moreover, depending upon the design goals of a given installation, it may be desirable to modify the dimensions of the ground plane 101, the dimensions of the folded mono-bow antenna elements 10*a* and 10*b*, the dimensions or orientation of the "T" shaped antenna elements 102*a* and 102*b*, the dimensions or orientation of the director elements 104*a*–104*d* or, perhaps, in some circumstances to substitute some other type of antenna (for example, another type of monopole antenna) for the antenna elements described above.

Figure 13A:
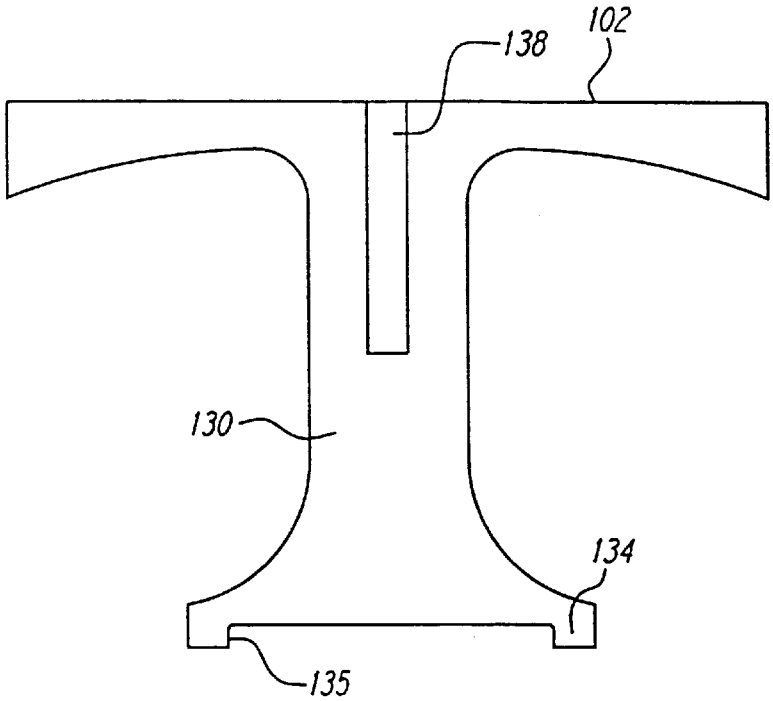
FIG. 13(*a*) is an illustration of a main radiating element of a preferred "T" shaped antenna utilized in the dual polarized bi-directional diversity antenna array shown in FIG. 12(*a*).
Figure 13B:
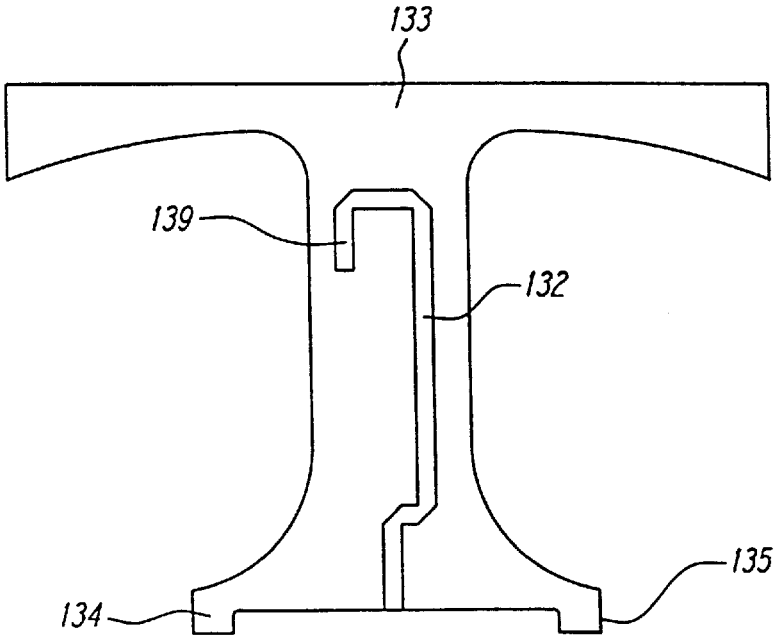
Figure 14A:
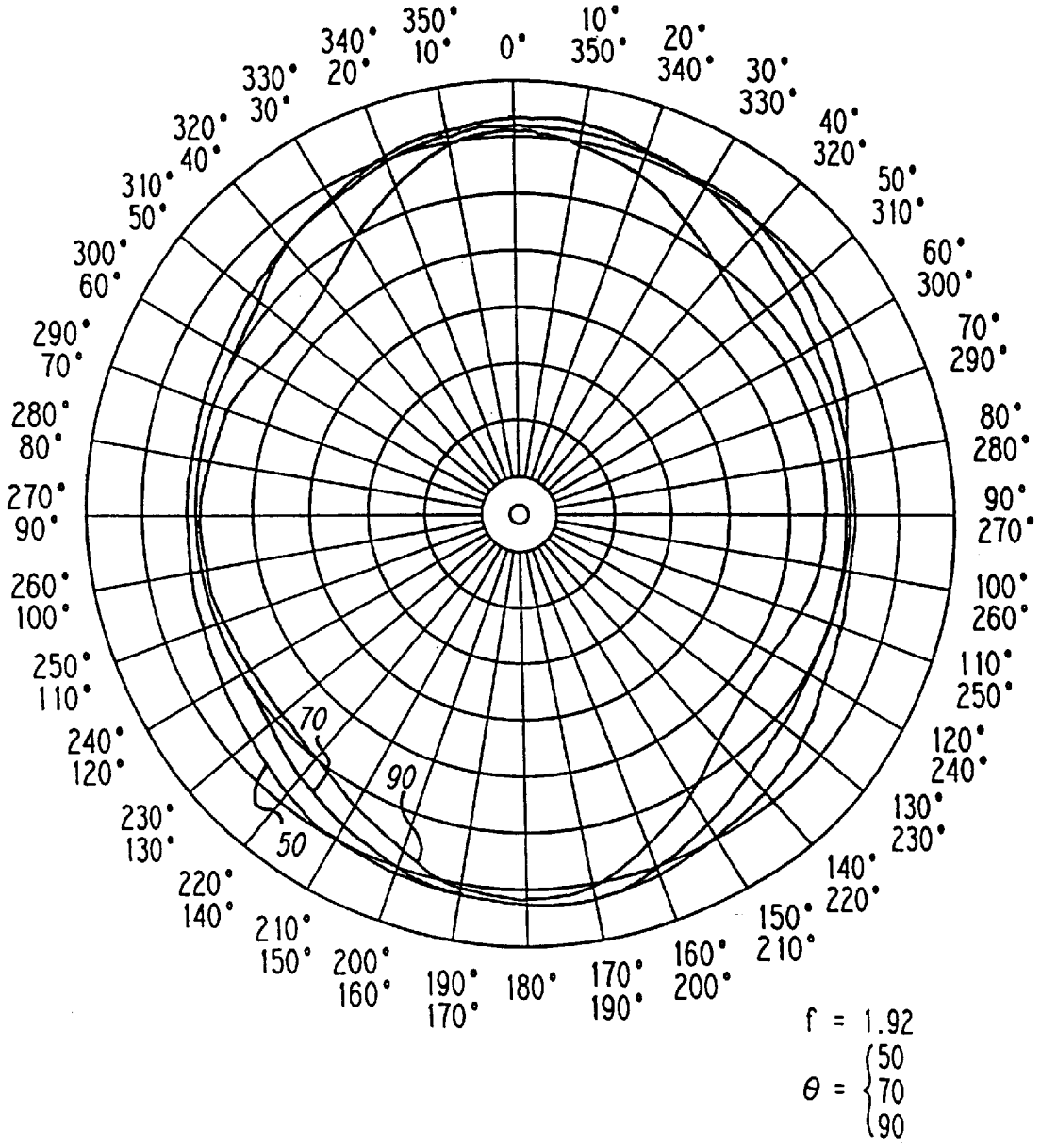
FIG. 14(*a*) is an illustration of a horizontally polarized conic cut radiation pattern in the vertical plane produced at the folded mono-bow antenna feed port of a dual polarized bi-directional diversity antenna when the antenna is mounted in accordance with the present invention.
Figure 14B:
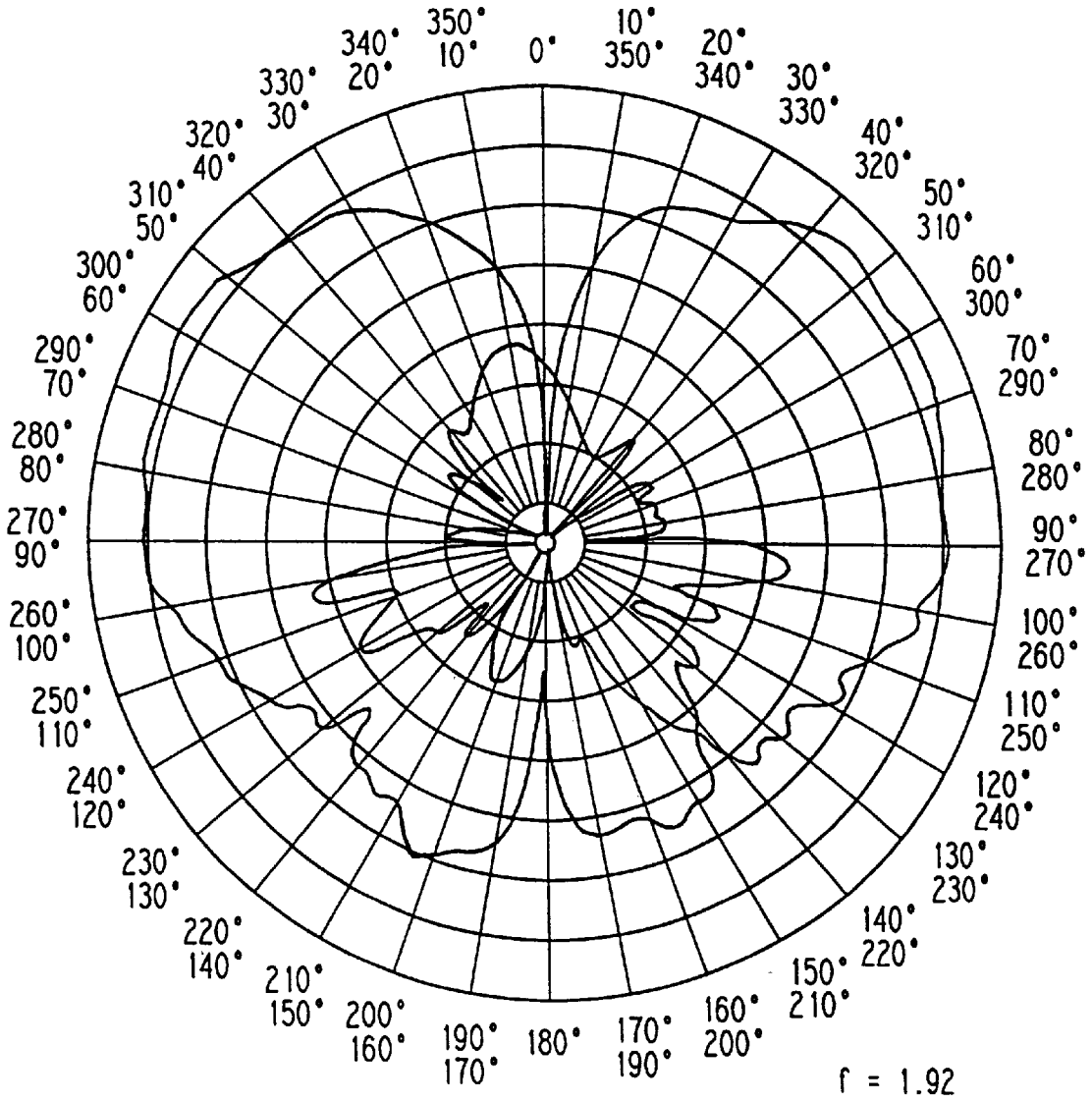
Figure 14C:
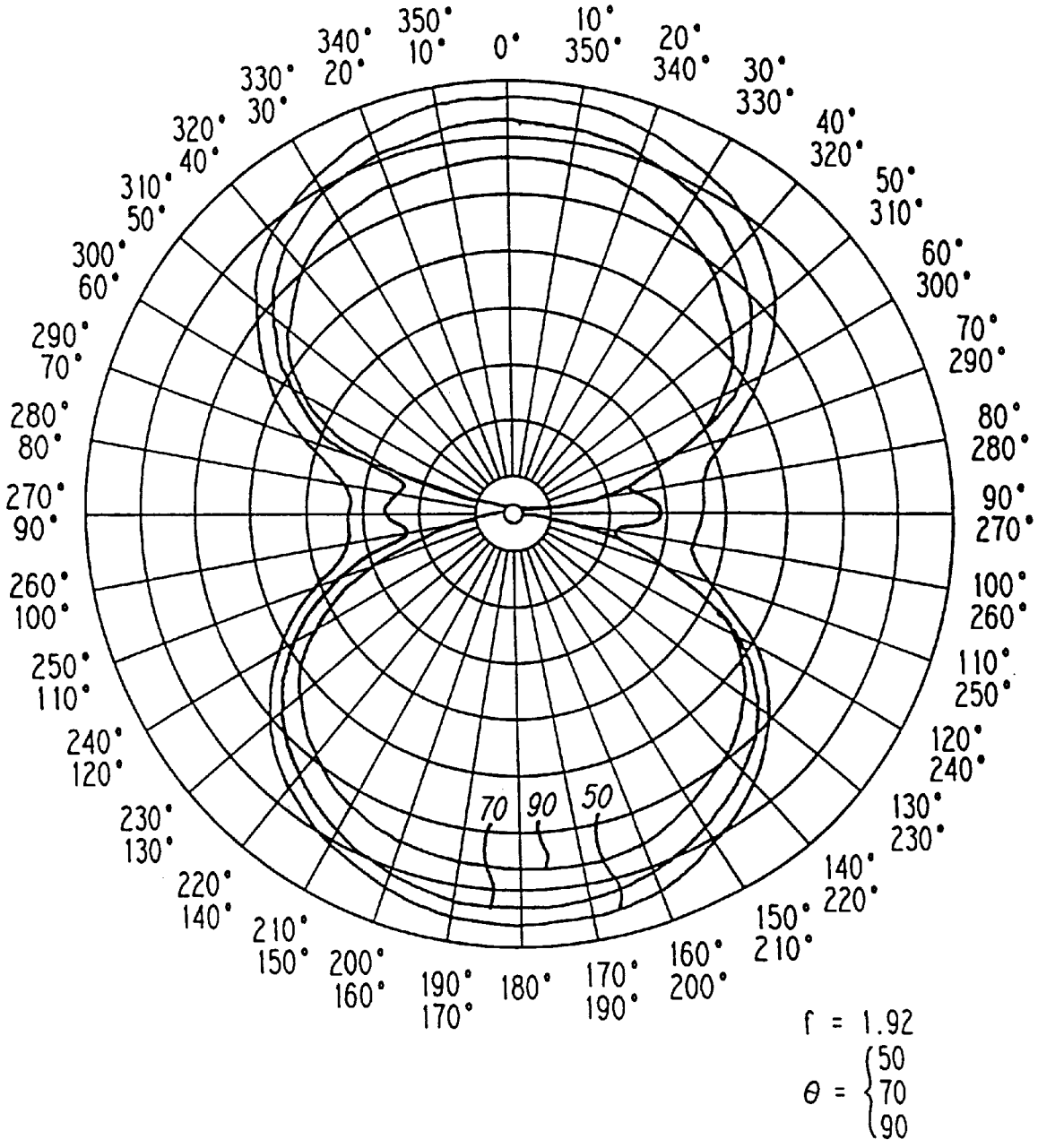
Figure 14D:
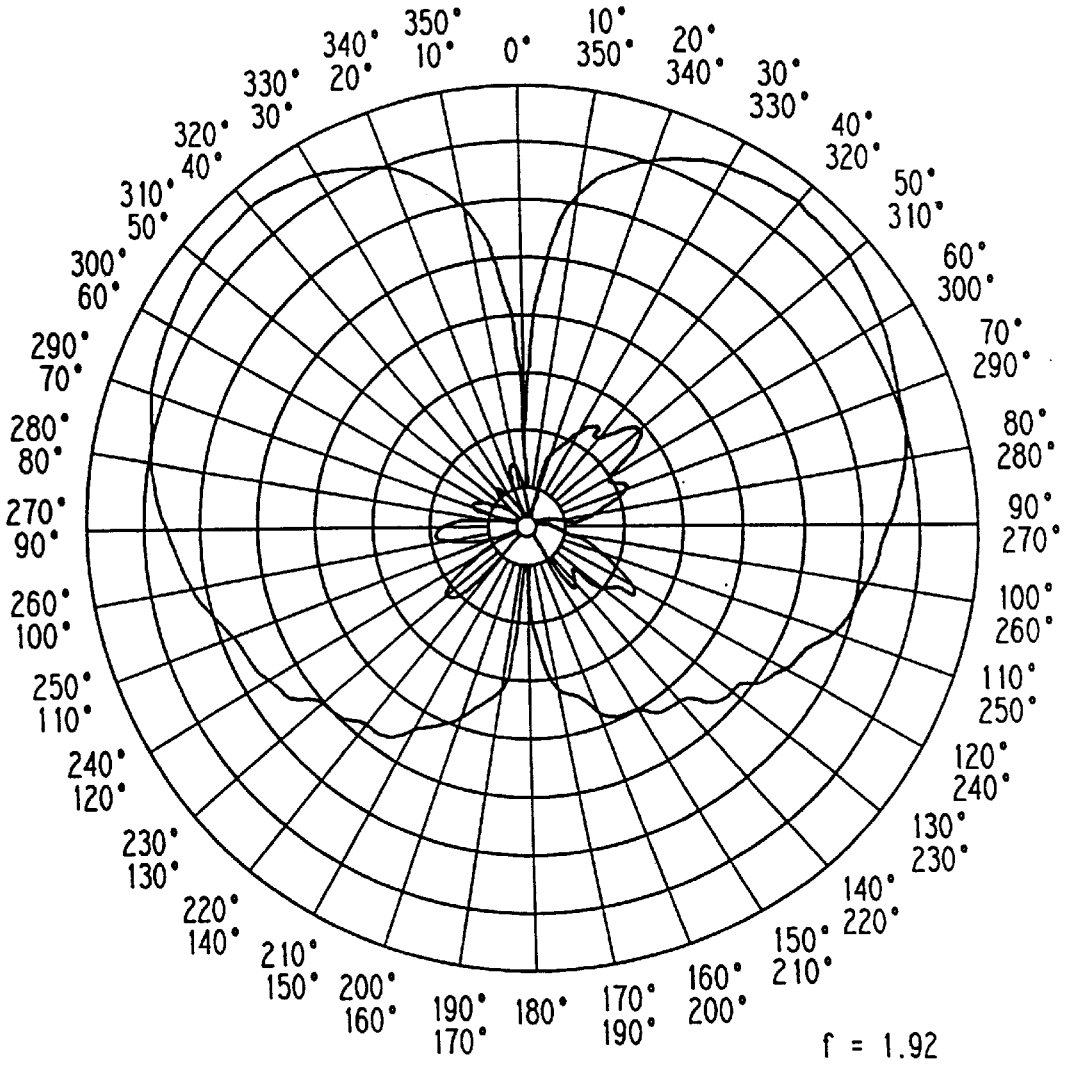

Turning now to FIGS. 13(*a*)–(*b*), the "T" shaped antenna elements 102*a* and 102*b* may comprise a large "T" shaped radiating element 130 and an inductive feed strip 132. The main "T" shaped radiating element 130 and the inductive feed strip 132 are formed on opposite sides of a PC board substrate 133. The main "T" shaped radiating element 130 is preferably mounted to the ground plane 101 by tabs 134 and 135 in the same manner as the folded mono-bow elements 210 as described above with the exception that the plating on the tabs is formed on the side of the substrate on which the radiating element is formed. The inductive feed strip 132 is preferably connected to microstrips 108 by feed pins 131 (shown in FIG. 12(*a*)), which extends through an insulated hole 137 formed in the common ground plane 101.

In a preferred form the main "T" shaped radiating element 130 and the inductive feed strip 132 are separated by a dielectric material (e.g., air or some other dielectric material) having a dielectric constant which is preferably less than or equal to 4.5. Further, while the shape and dimensions of the main "T" shaped radiating element 130 and feed strip element 132 may vary depending upon the operational characteristics desired for a particular application, it is presently preferred that the main "T" shaped radiating element 130 be 2.85" across the top and 1.97 inches high. The internal radius $R_1$ is preferably 0.2" and the internal radius $R_2$ is preferably 1.82". The width of the longitudinal body is preferably 0.6" wide. The radiating element slot 138 is preferably 0.15 inches wide and 0.95 inches long. The inductive feed strip 132 is preferably 0.070" wide and located 0.4" from the top of the element. The hook 139 of the inductive feed strip is preferably 0.3" long and the outside edges of the inductive feed strip are preferably 0.1" from the edge of the longitudinal edges of the "T" shaped antenna element.

Finally, as is the case with the folded mono-bow antenna elements 10 described above, it is presently preferred that the dielectric material utilized to construct the "T" shaped antenna elements 102*a* and 102*b* comprise a section of printed circuit board manufactured from woven TEFLON®, that the dielectric material have a thickness of approximately 0.03 inches, and that the dielectric material have an epsilon value (or dielectric constant) between 3.0 and 3.3. Moreover, it will be appreciated that the "T" shaped antenna elements 102*a* and 102*b* may be manufactured by depositing copper cladding in a conventional manner over opposite surfaces of the substrate, and etching portions of the copper cladding away to form the main "T" shaped radiating element 130 and the feed strip element 132.

Turning now also to FIG. 14(*a*), the in-phase summation of the energy from the two folded mono-bow antenna elements 210*a* and 210*b* at the folded mono-bow antenna feed port 133 results in a reduced elevation beamwidth, dual direction radiation pattern with peaks approximately at $\phi=0°$ and 180°, and 5 to 10 db down at $\phi=90°$ and 270° in the vertical plane. As shown in FIG. 14(*b*), the azimuth radiation pattern for the folded mono-bow antenna feed port 133 shows peak gains approximately at $\Theta=60°$ and 300°. As shown in FIG. 14(*c*) the summation of the energy patterns at the "T" antenna element feed port 135 results in a reduced elevation beamwidth, dual direction radiation pattern with peaks approximately at $\phi=0°$ and 180°, and nulls at $\phi=90°$ and 270°. Finally as shown in FIG. 14(*d*) the azimuth radiation pattern for the "T" antenna element feed port 135 shows peak gains approximately at $\Theta=50°$ and 310°.

It will be noted that the radiation pattern of the "T" port 146 is vertically polarized and the feed port 133 is horizontally polarized when properly mounted, thus enabling a radio system employing a dual polarized bi-directional diversity antenna array 100 in accordance with the present invention to provide multipath mitigation through polarization diversity and to provide polarization tracking of selected transceivers, such as found in wireless communication systems.

Figure 15:
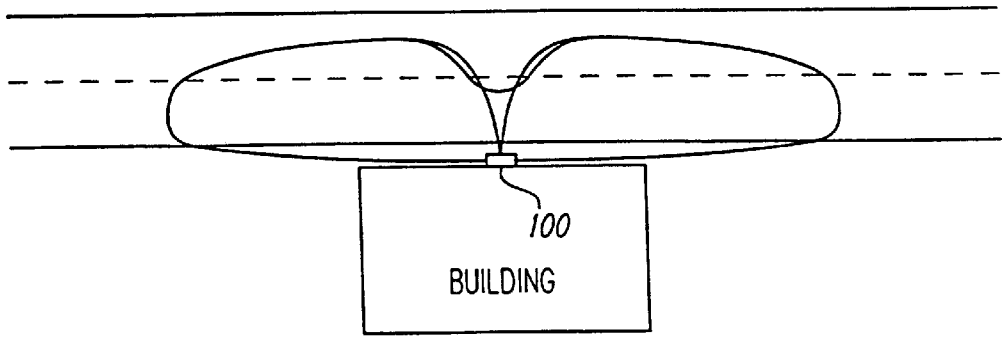
FIG. 15 illustrates a preferred deployment of a dual polarized bi-directional diversity antenna array in accordance with the present invention.

Given the above described properties of the radiation patterns of a dual polarized bi-directional diversity antenna array 100 in accordance with the present invention, such an array is well suited for mounting on building walls and other flat surfaces within a dense urban environment. The reason for this is that the nulls in the horizontal radiation pattern of, for example, the folded mono-bow antenna element feed port 133 of the antenna array 100 may be arranged orthogonally with the surface of a street, thus, minimizing multipath (i.e., beam reflections) emanating from the street or vehicles driving under the array 100. Further, the majority of the energy generated by the antenna array 100 is directed along the street, as shown in FIG. 15.

Finally, turning back to FIG. 12(*a*), in a preferred form the dual polarized bi-directional diversity antenna array 100 may be mounted in a casing comprising an aluminum base 150 and a plastic cover 152. The aluminum base 150 is formed such that the common ground plane 101 may be mounted within a step 154 formed in the outer wall 156 of the base 150, and such that the common ground plane 101 is coupled to the base 150 by means of a set of screws 158 insuring that the base 150 remains grounded during operation of the antenna array 100. The base 150 also has formed therein a pair of mounts for the coax connectors 114 and 116 and a series of threaded holes 160 for receiving a plurality of screws 162 which secure the cover 152 to the base 150.

While the invention of this application is susceptible to various modifications and alternative forms, specific examples thereof have been shown by way of example in the drawings and are herein described in detail. It is to be understood, however, that the invention is not to be limited to the particular forms or methods disclosed, but to the contrary, the invention is to broadly cover all modifications, equivalents, and alternatives encompassed by the spirit and scope of the appended claims.

What is claimed is:

1. A dipole antenna, comprising:

a longitudinal body having a base, a top, and a first and a second side edges between the base and the top;

a pair of laterally extending arms, each arm having a top edge and a bottom edge including a first arcuate segment merging with a corresponding side edge of the longitudinal body and having a radius R1 and a second arcuate segment merging with the first arcuate segment and having a radius R2 greater than R1, wherein a length of each arm is greater than a width of the longitudinal body; and an inductive feed strip extending along the stem.

2. The dipole antenna of claim 1, wherein:

the top edge of each arm is aligned with the top of the longitudinal body; and the longitudinal body has a slot extending from the top of the longitudinal body to a point between the top and the base of the longitudinal body.

3. The dipole antenna of claim 1, further comprising a ground plane, wherein the longitudinal body is attached to the ground plane and extends orthogonally therefrom.

4. The dipole antenna of claim 1, wherein the first arcuate segment forms a quarter circle.

5. The dipole antenna of claim 4 wherein R1 is 0.2 inches and R2 is 1.82 inches.

6. The dipole antenna of claim 2, wherein the slot has a width of 0.15 inches and extends longitudinally from the top of the longitudinal body a length of 0.95 inches.

7. The dipole antenna of claim 1, wherein the longitudinal body has a length of 1.97 inches.

8. The dipole antenna of claim 1, wherein said inductive feed strip has a first portion extending from the base of the longitudinal body along the first side edge to an upper end adjacent the top of the longitudinal body, a second portion extending from an upper end adjacent the top of the longitudinal body along the second side edge to a lower end between the top and the base of the longitudinal body, and a transverse portion coupled between the upper ends of the first and second portions.

9. A dipole antenna, comprising:

a longitudinal body having a base, a top, and a first and a second side edges between the base and the top;

a pair of laterally extending arms attached to the longitudinal body, each arm having a first portion adjacent the longitudinal body and a second portion opposite to the first portion, wherein a width of each arm in the first portion is less than a width of the arm in the second portion; and an inductive feed strip extending along the longitudinal body.

10. The dipole antenna of claim 9, wherein each arm has a concave bottom edge including:

a first arcuate segment adjacent the first portion, merging with a corresponding side edge of the longitudinal body, and having a first radius of curvature; and a second arcuate segment adjacent the section portion, merging with the first arcuate segment, and having a second radius of curvature greater than the first radius of curvature.

11. The dipole antenna of claim 9, wherein the longitudinal body has a slot extending from the top of the longitudinal body to a point between the top and the base of the longitudinal body.

12. The dipole antenna of claim 9, wherein the inductive feed strip includes:

a first section extending from the base along the first side edge to an upper end adjacent the top of the longitudinal body;

a second section extending from an upper end adjacent the top along the second side edge to a lower end between the top and the base of the longitudinal body; and a transverse section coupled between the upper ends of the first and second sections.

13. The dipole antenna of claim 9, wherein a length of each arm is significantly greater than a width of the longitudinal body.

14. The dipole antenna of claim 10, wherein the first arcuate segment forms a quarter circle.

15. The dipole antenna of claim 9, further comprising a ground plane, wherein the longitudinal body is attached to the ground plane and extends orthogonally therefrom.

16. A dipole antenna, comprising:

a longitudinal body having a base, a top, and a first and a second side edges between the base and the top;

a pair of laterally extending arms attached to the longitudinal body, each arm having a concave bottom edge including a first arcuate segment merging with a corresponding side edge of the longitudinal body and a second arcuate segment merging with the first arcuate segment, wherein a length of each arm is significantly greater than a width of the longitudinal body; and an inductive feed strip extending along the longitudinal body.

17. The dipole antenna of claim 16, wherein the longitudinal body has a slot extending from the top of the longitudinal body to a point between the top and the base of the longitudinal body.

18. The dipole antenna of claim 16, further comprising a ground plane, wherein the longitudinal body is attached to the ground plane and extends orthogonally therefrom.

19. The dipole antenna of claim 16, wherein the first arcuate segment forms a quarter circle of radius R1 and the second arcuate segment has a radius of curvature R2 greater than R1.

20. The dipole antenna of claim 16, wherein the inductive feed strip has a first portion extending from the base of the longitudinal body along the first side edge to an upper end adjacent the top of the longitudinal body, a second portion extending from an upper end adjacent the top of the longitudinal body along the second side edge to a lower end between the top and the base of the longitudinal body, and a transverse portion coupled between the upper ends of the first and second portions.

* * * * *